United States Patent [19]

Yamada et al.

[11] Patent Number: 4,985,878

[45] Date of Patent: Jan. 15, 1991

[54] ELECTRONIC TIMEPIECE WITH ANALOG TIME DISPLAY UNIT AND ELECTROOPTIC DATA DISPLAY UNIT

[75] Inventors: Wataru Yamada, Tachikawa; Yukio Kido, Fussa; Hiroyuki Abe, Fussa; Shunji Minami, Fussa; Shigeru Katoh, Tachikawa; Junro Yano, Fussa, all of Japan

[73] Assignee: Casio Computer Co., Ltd., Tokyo, Japan

[21] Appl. No.: 443,081

[22] Filed: Nov. 27, 1989

Related U.S. Application Data

[63] Continuation of Ser. No. 403,304, Sep. 5, 1989, abandoned.

[30] Foreign Application Priority Data

| | | | |
|---|---|---|---|
| Sep. 12, 1988 | [JP] | Japan | 63-226576 |
| Dec. 27, 1988 | [JP] | Japan | 63-168654[U] |
| Mar. 6, 1989 | [JP] | Japan | 1-24715[U] |
| Mar. 17, 1989 | [JP] | Japan | 1-29828 |
| Mar. 20, 1989 | [JP] | Japan | 1-30798[U] |
| Mar. 20, 1989 | [JP] | Japan | 1-30793 |
| Mar. 20, 1989 | [JP] | Japan | 1-30794 |
| Jun. 29, 1989 | [JP] | Japan | 1-165294 |

[51] Int. Cl.[5] ..... G04B 25/00; G04B 19/00

[52] U.S. Cl. ..... 368/88; 368/223; 368/276

[58] Field of Search ..... 368/76, 80, 82, 88, 368/223, 276, 277, 278–283

[56] References Cited

U.S. PATENT DOCUMENTS

| | | | |
|---|---|---|---|
| 3,788,060 | 1/1974 | Kawamura | 368/255 |
| 4,108,340 | 8/1978 | Conn | 368/281 |
| 4,236,239 | 11/1980 | Imgruth et al. | 368/88 |
| 4,436,435 | 3/1984 | Ushikoshi | 368/71 |
| 4,444,513 | 4/1984 | Proellochs | 368/223 |

FOREIGN PATENT DOCUMENTS 60-86993 6/1985 Japan .

*Primary Examiner*—Vit W. Miska

*Attorney, Agent, or Firm*—Frishauf, Holtz, Goodman & Woodward

[57] ABSTRACT

A case member is coupled to a plate member so as to be movable between an opening position and a closing position with respect to the plate member. A switch input section is mounted on the upper surface of the plate member. An analog display unit for displaying time with hands is arranged on the upper surface of the case member. An electrooptic data display unit for displaying data is arranged on the lower surface of the case member. An electronic circuit for driving the analog display unit and the electrooptic data display unit is housed in the case member. The switch input section on the plate member is electrically connected to the electronic circuit of the case member. Data input from the switch input section to the electronic circuit is processed thereby and is displayed on the electrooptic data display unit. When the case member is set at the closing position, only the analog display unit is exposed. When the case member is set at the opening position, the electrooptic data display unit and the switch input section are exposed, and functions other than a watch function can be executed.

14 Claims, 37 Drawing Sheets

ELECTRONIC TIMEPIECE WITH ANALOG TIME DISPLAY UNIT AND ELECTROOPTIC DATA DISPLAY UNIT

This application is a continuation of application Ser. No. 07/403,340, filed Sept. 5, 1989, now abandoned.

BACKGROUND OF THE INVENTION

1. Field of the Invention

The present invention relates to an electronic timepiece including an analog time display unit for indicating time with hands and an electrooptic data display unit for displaying data.

2. Description of the Related Art

A combination wristwatch has recently been available. The combination wristwatch is a combination of a hand display type electronic wristwatch for displaying time with hands, to which a variety of functions, e.g., a function of displaying a date and a day of the week, an alarm function, and a stopwatch function, are added, and a liquid crystal data display unit for displaying these data.

In such a combination wristwatch, two display portions of an analog time display unit and an electrooptic data display unit are mounted side by side on a single surface of a case. In order to reduce the wristwatch in size at least one of the areas of the two display portions must be reduced. As a result, a display on a small area display portion becomes difficult to see. In contrast to this, if both the areas are increased to allow displays on the two display portions to be easily seen, the planar shape of the case of the wristwatch is increased in size.

Recently, in addition to the above-mentioned relatively simple functions, the above wristwatch is equipped with more sophisticated functions such as a telephone number storing function and a calculator function. For this reason, a large number of switches must be newly mounted on the case. This further increases the planar shape of the wristwatch case in size.

In a wristwatch with a calculator disclosed in U.S. Pat. No. 4,108,340, watch and calculator cases in which an analog display type watch and a calculator are respectively housed are fixed back to back, and a band is inserted in a through hole formed between the cases. The band can be freely reversed in the through hole. The two cases can be reversed on the band as needed so as to selectively set the analog watch or the calculator in the same direction as that of the surface of the band. In such a watch, the planar shape of the pair of cases can be reduced in size. However, the thickness of the pair of cases is increased. Although the time display portion of the analog watch can be increased in size, since the display portion of an electrooptic data display unit of the calculator and an operation portion of a switch unit are mounted side by side on a single surface, the data display portion is reduced in size, or the number of switch units which can be arranged is undesirably limited.

In a dual display watch disclosed in U.S. Pat. No. 4,444,513, a watch case is constituted by upper and lower half cases. An analog time display unit is arranged in the upper half case, whereas an electrooptic data display unit and a switch unit are arranged in the lower half case. The upper half case is coupled to the lower half case so as to be freely opened/closed. Similarly, in this watch, since the upper and lower half cases are stacked on each other, the thickness of the watch case is increased. Although the display portion of the analog time display unit can be increased in size, since the da&a display portion of the electrooptic data display unit and an operation portion of the switch unit are mounted on a signal surface of the lower half case, the data display portion must be reduced in size with an increase in number of switch units, or the number of switches which can be arranged is undesirably limited.

In the above-described two U.S. Patents, in order to increase the data display portion in size and increase switches .n number, the calculator case and the lower half case must be increased in size. As a result, the planar shape of the watch case is inevitably increased in size.

SUMMARY OF THE INVENTION

It is an object of the present invention to provide an electronic timepiece including an analog time display unit and an electrooptic data display unit having a low-profile, small watch case, in which the display portions of the analog time display unit and the electrooptic data display unit can be increased in size, and a large number of switch units can be arranged.

In order to achieve the above object, according to the present invention, there is provided an electronic timepiece comprising:

a plate member having a switch input portion for data input mounted on an upper surface thereof;

a case member mounted on one end of the plate member so as to be freely opened and closed;

an analog time display unit, housed at an upper position in the case member, for displaying time with hands;

an electrooptic data display unit, housed in at a lower position in the case, for displaying data; and an electronic circuit, housed in the case member, for driving the analog time display unit, the electronic circuit being electrically connected to the switch input section so as to cause the electrooptic data display unit to display data input from the switch input section.

According to the above-described arrangement, although the overall timepiece case is reduced in profile and size, the areas of the display portions of the analog time display unit and the electrooptic data display unit can be increased, and moreover, a large number of switch units can be arranged, thereby providing a multifunctional electronic timepiece in which display contents on the display portions are easy to see and operability of the switch portion is excellent. Such an arrangement is especially suitable for small timepiece such as wristwatches. In addition, if the case member is closed, the timepiece looks like an analog timepiece and is excellent in design.

DETAILED DESCRIPTION OF THE PREFERRED EMBODIMENTS

Figure 1A:
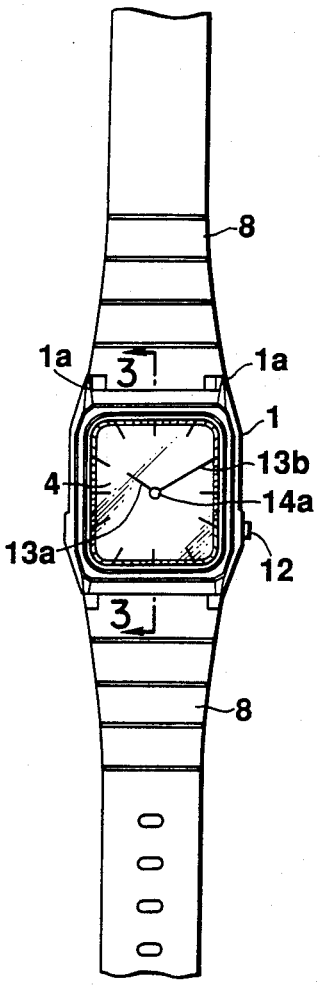
FIG. 1A is a plan view showing an electronic wristwatch according to a first embodiment of the present invention in a state wherein a case is closed.

A first embodiment of the present invention will be described below with reference to FIGS. 1 to 5.

An electronic wristwatch of the first embodiment is a multifunctional timepiece. As shown in FIGS. 1A, 1B, 2A, and 2B, a case 1 is attached to a plate 2 by using pins 3 so as to be freely opened and closed. In this case, analog and digital display sections 4 and 5 are respectively formed on the upper and lower surfaces of the case 1. A sheet switch 6 is arranged on the upper surface of the plate 2. The sheet switch 6 and the digital display section 5 are electrically connected to each other through a flexible wiring board 7. Watch bands 8 are respectively attached to the front and rear ends of the plate 2. The respective members will be sequentially described below with reference to FIGS. 3 and 4.

The case 1 is made of a metal such as stainless steel, a synthetic resin, or the like and is constituted by upper and lower half cases 1*a* and 1*b*. A watch glass 9 is fitted in the upper surface of the upper half case 1*a* through a packing 9*a*. A housing 10 in which the analog and digital display sections 4 and 5 are housed is arranged in the case 1. The upper and lower half cases 1*a* and 1*b* are coupled to each other through a waterproof ring 11*a* by using screws 11*b*. Note that a push button switch 12 is arranged on the periphery of the case 1. This push button switch 12 serves as not only an ON/OFF switch of a lamp for illuminating the analog display section 4 and but also as an alarm stop switch for stopping an alarm sound.

The analog display section 4 moves hands 13 to display time. A hand shaft 14*a* of an analog movement 14 housed in the housing 10 protrudes upward through a center hole 15*a* formed in a dial plate 15 arranged on an upper portion of the housing 10. The hands 13 such as hour and minute hands 13*a* and 13*b* are attached to the upper end of the hand shaft 14*a*, and the hands 13 are moved above the dial plate 15. In this case, a piezoelectric element 16 for generating an alarm sound is fixed to the lower surface of the dial plate 15.

The digital display section 5 electrooptically displays data such as time and is constituted by a liquid crystal display panel (electrooptic data display element) 17, a circuit board 18, and the like which are housed in the housing 10. More specifically, the liquid crystal display panel 17 is electrically connected to the circuit board 18 through a film board 20 and an interconnector 21. The display panel 17 electrooptically displays various data, e.g., time, a memo, and a schedule, and corresponds to a display glass 19 arranged at a predetermined position of the lower half case 1*b*. The circuit board 18 includes a quartz oscillator and various electronic parts such as LSIs (not shown) required for a watch function, a calculation function, a storage function, and the like, and is placed at the center in the housing 10. Note that a battery cover 22 is arranged on one side of the display glass 19 in the lower half case 1*b*, and a battery 23 is housed inside the cover 22.

The plate 2 is made of a metal such as stainless steel or a synthetic resin and is substantially flat. A switch housing recess 2*a* is formed in the upper surface of the plate 2. Band attaching portions 24 and 25 are respectively formed at both the ends of the plate 2. Of these band attaching portions 24 and 25, a pair of band attaching portions 24 are located at a lower position in FIG. 4 and project from the right and left ends of the lower edge of the plate 2. The proximal end of the lower watch band 8 is placed between the pair of portions 24, and the band 8 is attached to these portions 24 by using the pins 3 inserted from the outside of the pair of band attaching portions 24. A pair of band attaching portions 25 are located at an upper position in FIG. 4 and project at positions slightly inward from the right and left ends of the upper edge of the plate 2. The proximal end of the upper watch band 8 is placed between the pair of portions 25, and at the same time a pair of attaching portions 27 of the upper half case la are placed outside these portions 25. The case 1 is pivotally attached to the pair of portions 25, and at the same time the watch band 8 is attached thereto by using the pins 3 inserted from the outside of the pair of portions 25 in the same manner as described above.

Figure 4:
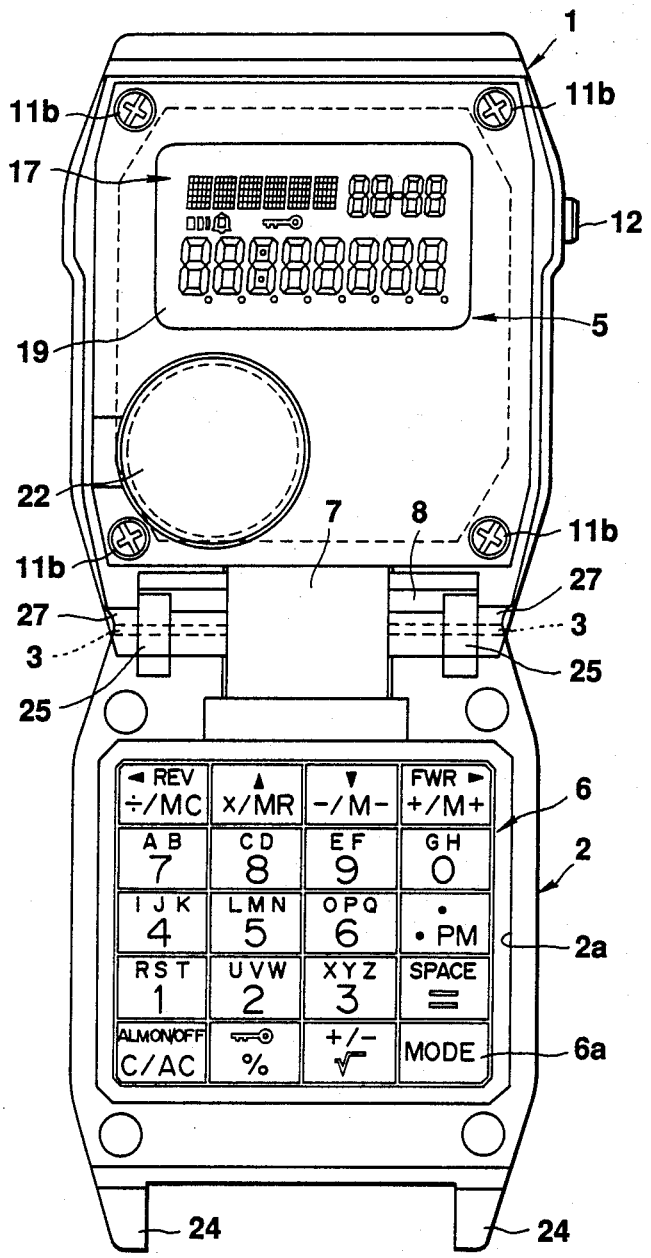
FIG. 4 is an enlarged view showing a main part of the electronic wristwatch in FIG. 2A.

The sheet switch 6 serves as a key input section and includes a large number of keys. The sheet switch 6 is arranged in the switch housing recess 2*a* formed in the upper surface of the plate 2. The sheet switch 6 comprises a flexible film having a lower surface on which movable contacts are mounted in the form of a matrix, a spacer arranged on the lower surface of the flexible film and having openings at positions corresponding to the movable contacts, and a hard board mounted on the lower surface of the spacer and having stationary contacts which can be connected/disconnected to/-from the movable contacts through the openings of the spacer. As shown in FIG. 4, a plurality of letter keys are assigned to the respective keys of a ten-key pad and function keys. A mode key (MODE) 6*a* is arranged at a predetermined position (lower right corner) of the sheet switch 6. A time display mode, a memo mode, a schedule mode, a telephone mode, and a calculation mode are cyclically set in an electronic circuit 28 shown in FIG. 5 every time the mode key 6*a* is depressed.

The flexible wiring board 7 electrically connects the sheet switch 6 to the circuit board 18 of the digital display section 5. The board 7 is designed such that a large number of wires are formed into a pattern or a surface of a flexible film and are coated with an insulating material. One end of the flexible wiring board 7 is connected to the sheet switch 6. An intermediate portion of the board 7 is located near the coupling portion of the case 1 and the plate 2. The other end of the board 7 is inserted in the case 1 and connected to the circuit board 18 on a base 26 in the housing 10 through an interconnector 27. Therefore, the intermediate portion of the flexible wiring board 7 is elastically bent upon an opening/closing operation of the case 1.

Figure 5:
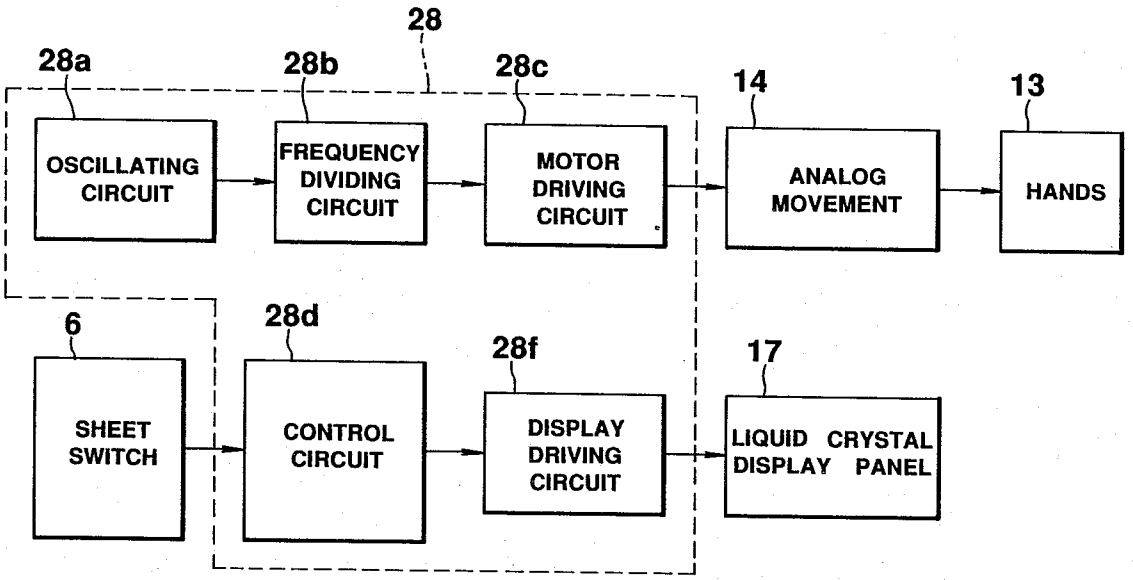
FIG. 5 is a block diagram showing a circuit arrangement of the electronic wristwatch in FIG. 1A.

FIG. 5 is a block diagram showing a schematic circuit arrangement of the electronic wristwatch of the first embodiment.

Reference numeral 28 denotes an electronic circuit for driving the analog and digital display sections 4 and 5. The electronic circuit 28 outputs a drive pulse to a step motor of the analog movement 14. Upon reception of the drive pulse, the step motor is rotated. This rotation is transmitted to the hands 13 through a wheel train mechanism of the analog movement 14 so as to rotate the hands 13. In addition, the electronic circuit 28 receives a key input signal from the sheet switch 6. The electronic circuit 28 converts data based on the key input signal into a display drive signal and outputs it to the liquid crystal display panel 17.

The electronic circuit 28 includes an oscillating circuit 28*a* for generating a reference signal, a frequency dividing circuit 28*b* for frequency-dividing an output from the circuit 28*a* to obtain one frequency-divided lP/M signal, and a motor driving circuit 28*c* for generating one frequency-divided drive pulse on the basis of the lP/M signal from the circuit 28*b* and outputting it to the step motor of the analog movement 14.

The electronic circuit 28 further includes a control circuit 28*d*, electrically connected to the sheet switch 6, for obtaining data based on an input signal from the sheet switch 6, and a display driving circuit 28*f* for receiving the data obtained by the circuit 28*d*, converting the data into a display drive signal, and supplying it to the liquid crystal display panel 17, thereby displaying the data on the display panel 17.

Figure 1B:
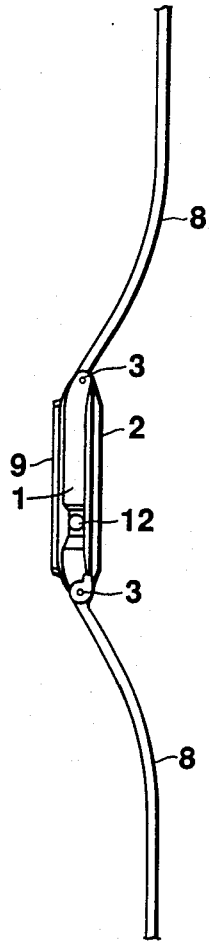
FIG. 1B is a side view showing the wristwatch in FIG. 1A in a state wherein the case is closed.
Figure 2A:
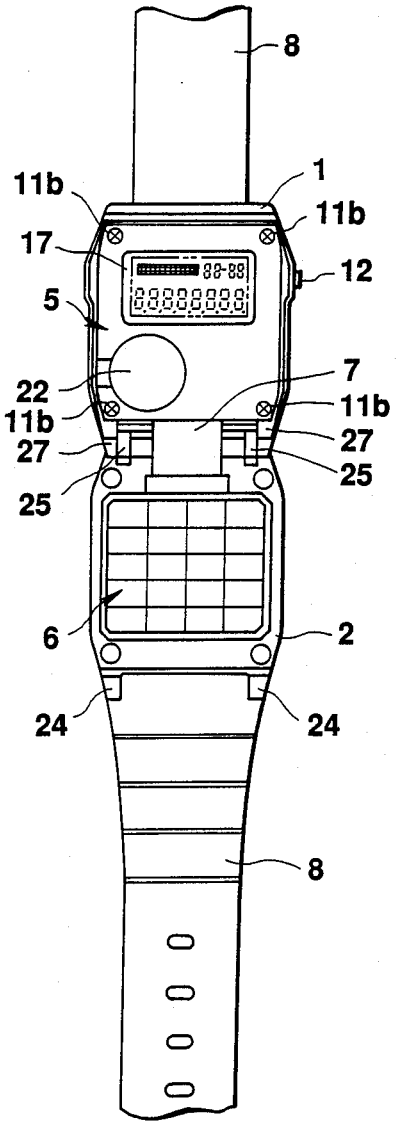
FIG. 2A is a plan view showing the electronic wristwatch in FIG. 1A in a state wherein the case is open.
Figure 2B:
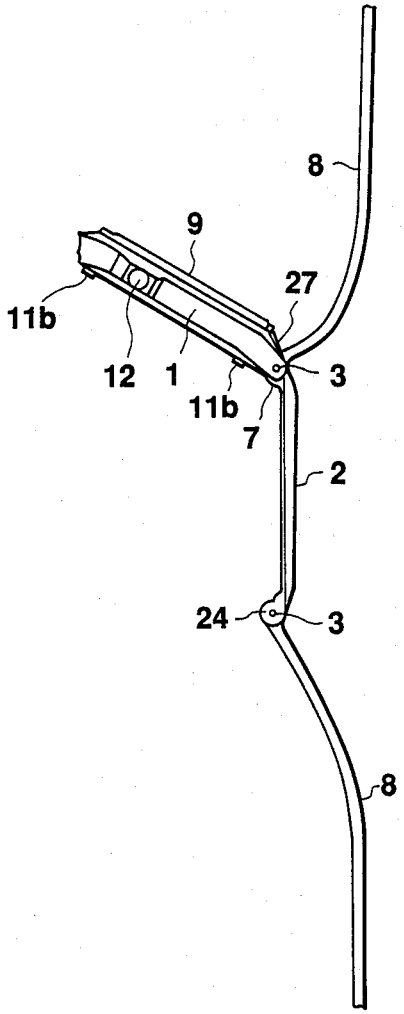
FIG. 2B is a side view showing the electronic watch in FIG. 1A in a state wherein the case is open.
Figure 3:
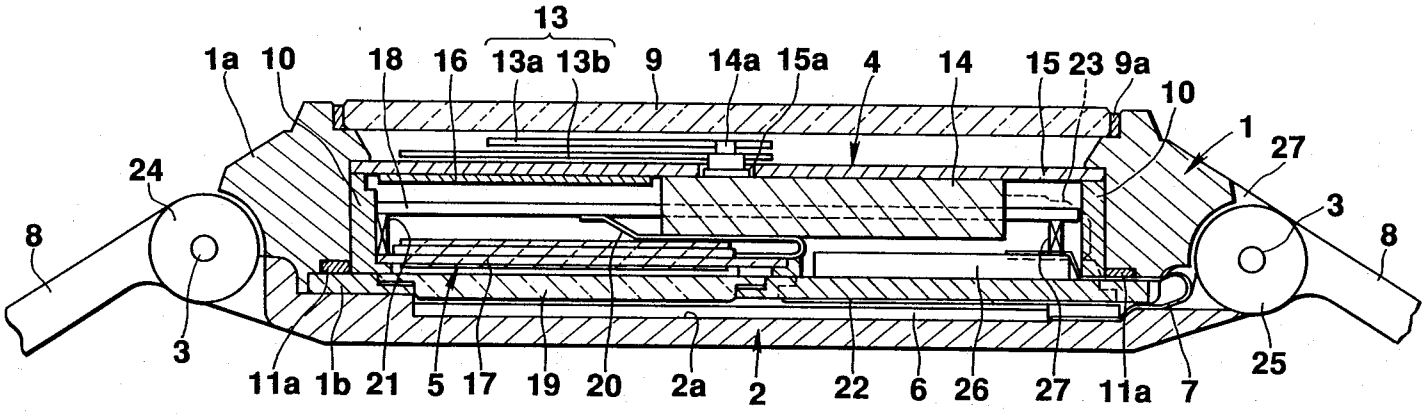
FIG. 3 is a sectional view taken along a line A—A in FIG. 1A.

A method of using the electronic wristwatch having the above-described arrangement will be described below. If the case 1 is pivoted to the closing position and is stacked on the plate 2, the watch looks like a normal analog watch, as shown in FIGS. 1A and 1B. In this case, time is indicated by the hands 13, and the electronic wristwatch becomes compact in outer appearance and easy to carry. If the case 1 is pivoted to the opening position and is separated from the plate 2, the digital display section 5 mounted on the lower surface of the case 1 and the sheet switch 6 mounted on the plate 2 appear, as shown in FIGS. 2A, 2B, and 4. In this case, when the respective keys of the sheet key 6 are operated, predetermined data can be displayed on the liquid crystal display panel 17 of the digital display section 5. For example, if the mode key 6*a* of the sheet switch 6 is repeatedly operated, the time display mode, the memo mode, the schedule mode, the telephone mode, and the calculation mode are cyclically set in the electronic circuit 28. Data corresponding to a key operation in each mode is displayed on the display panel 17.

As described above, in this electronic wristwatch, the analog and digital display sections 4 and 5 are respectively mounted on the upper and lower surfaces of the case 1. The case 1 is pivotally attached to the plate 2 having the sheet switch 6 on its upper surface by using the pins 3 and can be stacked thereon. The sheet switch 6 of the plate 2 and the digital display section 5 of the case 1 are connected to each other through the flexible wiring board 7. With this arrangement, an increase in size of the overall watch case can be prevented, and hence a compact case can be realized. At the same time, a high-performance multifunctional watch can be realized. In addition, since the surface areas of the analog and digital display sections 4 and 5 and the key operation portion area of the sheet switch 6 do not limit each other, these areas can be set to substantially coincide with the upper and lower surfaces of the case 1 and the upper surface of the plate 2, respectively. As a result, the display sections 4 and 5 become easy to see, and at the same time operability of the respective keys of the sheet switch 6 can be improved. Especially, since the case 1 and the plate 2 are pivotally attached to each other by using the pins 3 for attaching the watch band 8, a structure for pivotal coupling can be simplified, and the number of parts can be reduced. Moreover, since coupling of the case 1 and the plate 2 can be completed by only inserting the pins 3 from the outside, assembly is facilitated.

Figure 6:
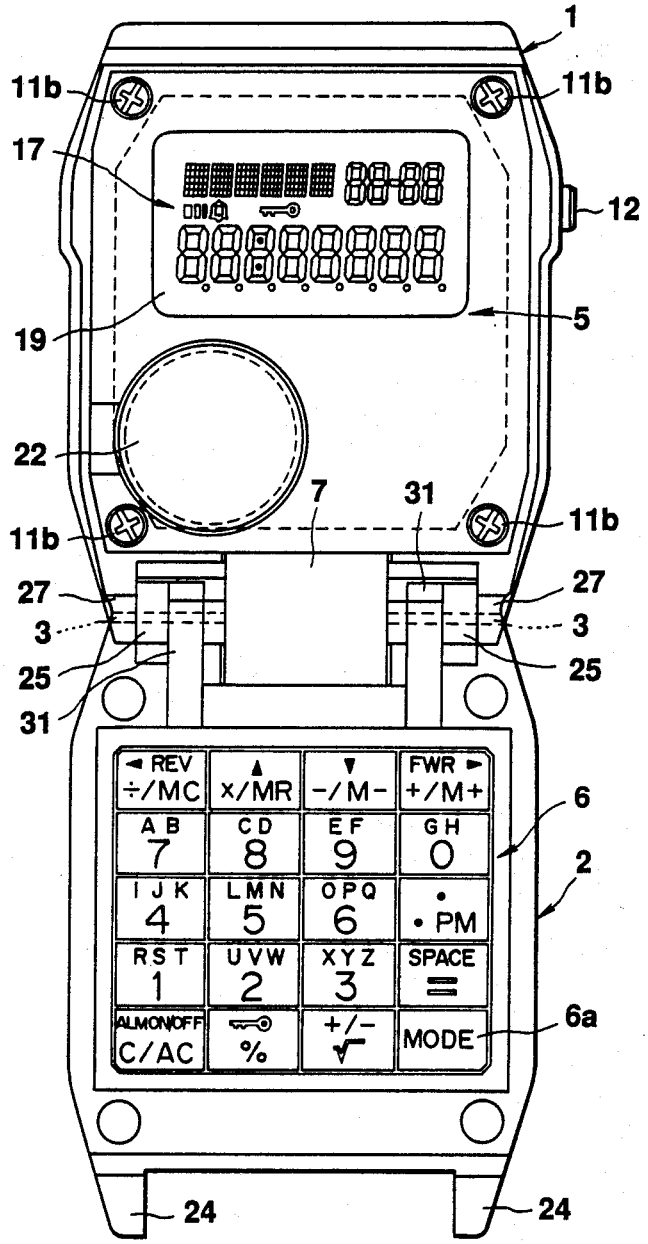
FIG. 6 is a plan view showing a main part of an electronic wristwatch according to a second embodiment of the present invention in a state wherein a case is open.
Figure 7:
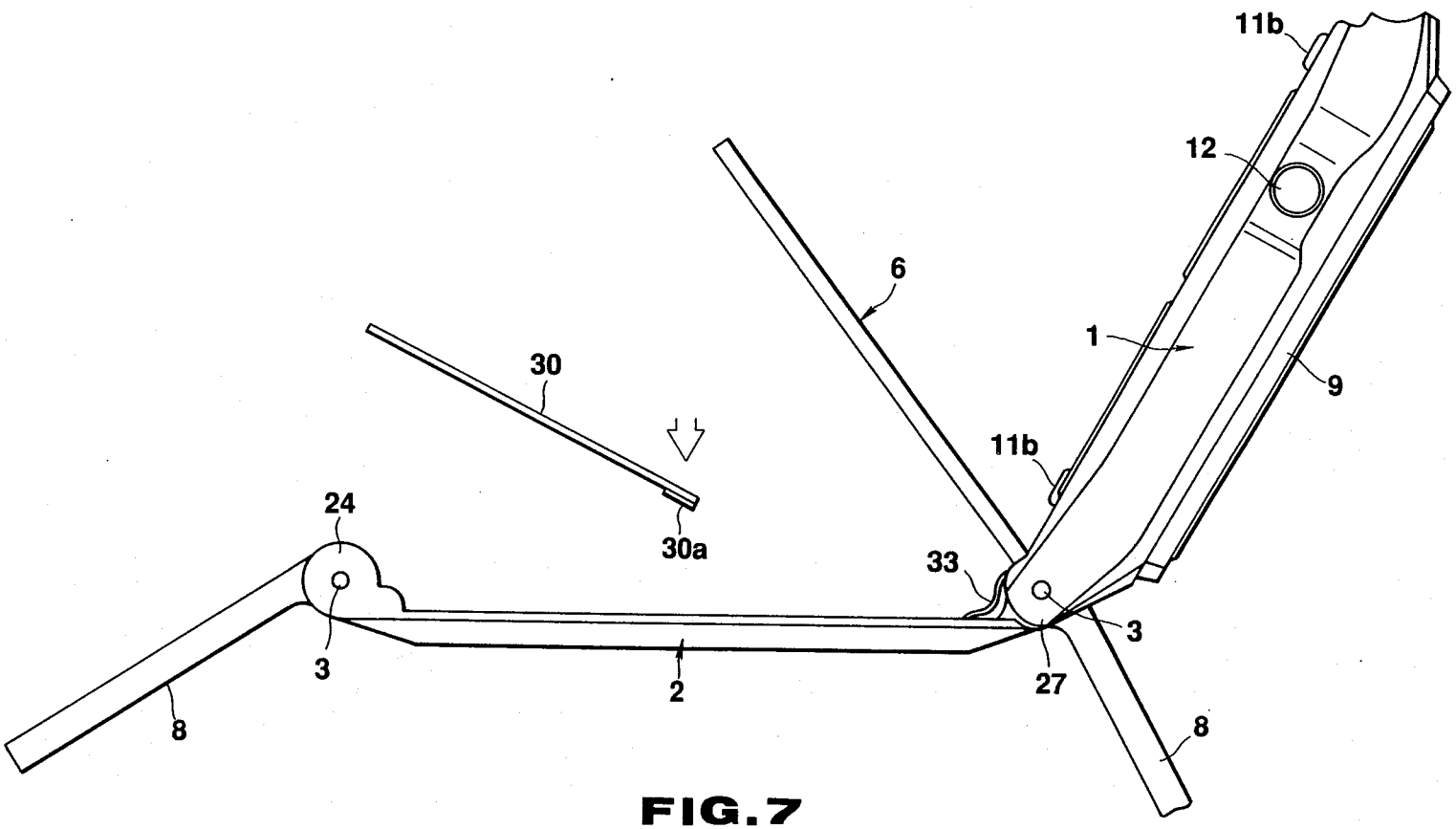
FIG. 7 is a side view showing an electronic wristwatch in FIG. 6 in a state wherein a switch portion is open.
Figure 8:
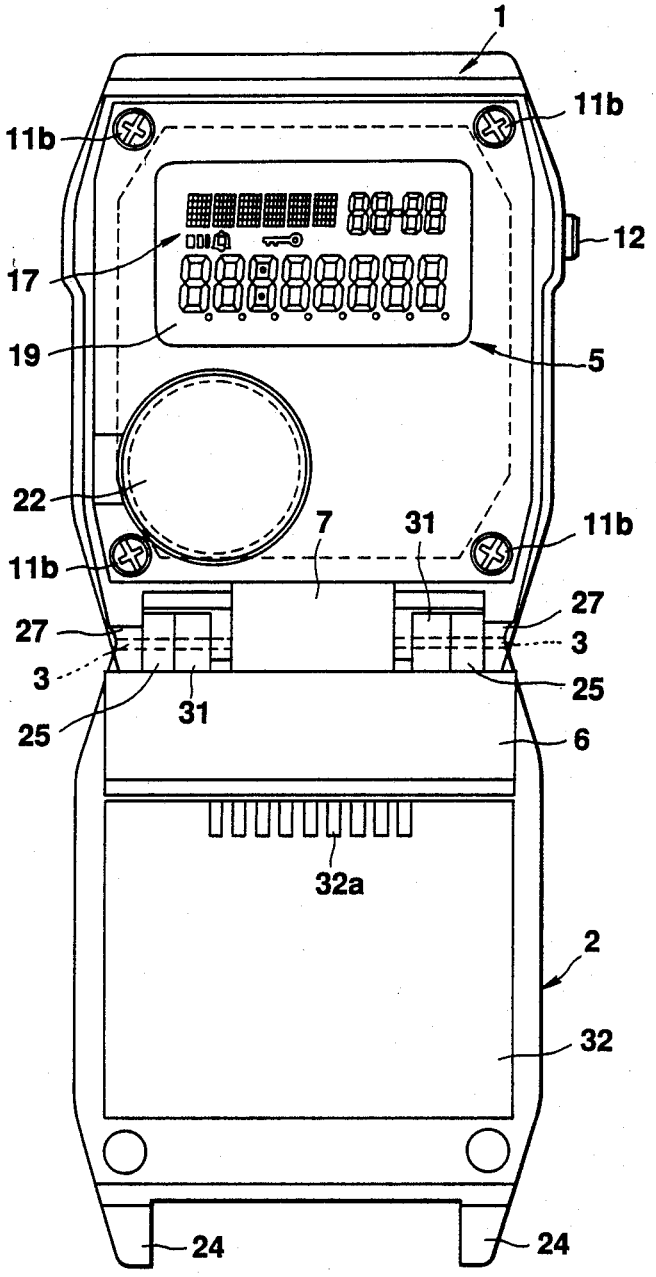
FIG. 8 is a plan view showing a main part of the electronic wristwatch in FIG. 7.

A second embodiment of the present invention will be described below with reference to FIGS. 6 to 8. The same reference numerals in the second embodiment denote the same parts as in the first embodiment, and a description thereof will be omitted.

In an electronic wristwatch of the second embodiment, a sheet switch 6 which is mounted on the upper surface of a plate 2 is pivotally attached to the plate 2. An IC card 30 is housed at the upper surface of the plate 2 which is covered with the sheet switch 6. More specifically, a pair of coupling arms 31 are mounted on the sheet switch 6. The coupling arms 31 respectively extend along the inner sides of a pair of band attaching portions 25 formed on the upper edge of the plate 2. The proximal end of one watch band 8 is arranged between the pair of coupling arms 31 of the sheet switch 6. The pair of coupling arms 31 of the sheet switch 6 and the proximal end of one watch band 8 ar pivotally attached to a pair of band attaching portions 25 by using common pins 3. As shown in FIG. 7, the pins 3 are inserted from the outside of a pair of band attaching portions 27 of the case 1. As is clearly shown in FIG. 8, a card housing recess 32 is formed in the upper surface of the plate 2. The IC card 30 comprising an integrated circuit chip is detachably housed in the card housing recess 32, as shown in FIG. 7. Connecting terminals **32*a* (FIG. 8) are formed on the upper edge of the bottom surface of the plate 2 at equal intervals. The connecting terminals 32*a* are electrically connected to a circuit board 18 in the case 1 through a flexible lead 33 (FIG. 7) in the same manner as described in the first embodiment. When the IC card 30 is housed in the card housing recess 32, terminals 30*a* of the IC card 30 are connected to the connecting terminals 32*a***.

According to the above-described electronic wristwatch, therefore, if the IC card 30 is housed in the card housing recess 32 so as to cause the terminals **30*a* of the IC card 30 to correspond to the connecting terminals 32*a* of the card housing recess 32, data can be exchanged between the IC card 30 and the digital display section 5**. With this arrangement, the electronic wristwatch of the second embodiment is superior to that of the first embodiment in terms of performance and the number of functions.

Figure 9:
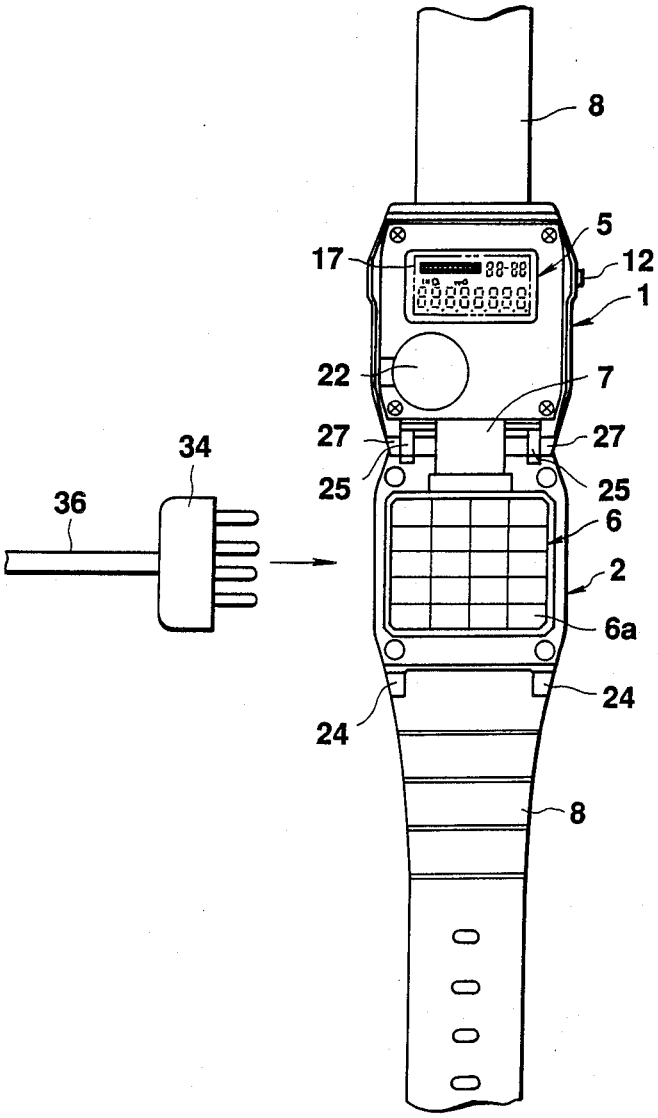
FIG. 9 is a plan view showing an electronic wristwatch according to a third embodiment of the present invention in a state wherein a case is open.

A third embodiment of the present invention will be described below with reference to FIG. 9. Similarly, the same reference numerals in the third embodiment denote the same parts as in the first embodiment, and a description thereof will be omitted.

A connector 34 can be detachably connected to an electronic wristwatch of the third embodiment so as to allow data exchange with an external device. More specifically, a connecting portion (not shown) to which the connector 34 is detachably connected is mounted in a side surface of a plate 2. The connecting portion is electrically connected to a digital display section 5 through a flexible wiring board 7 which connects a sheet switch 6 as described above to the digital display section 5 of a case 1. In addition, the connector 34 is connected to an external device through a cord 36. The external device includes a wordprocessor, a personal computer, a printer, a radio pager, and the like.

According to the above electronic wristwatch, therefore, if the connector 34 is connected to the connecting portion of the plate 2, data can be exchanged between an external device and the digital display section 5. Similar to the second embodiment, the electronic wristwatch of the third embodiment is superior to that of the first embodiment in terms of performance and the number of functions.

Figure 10:
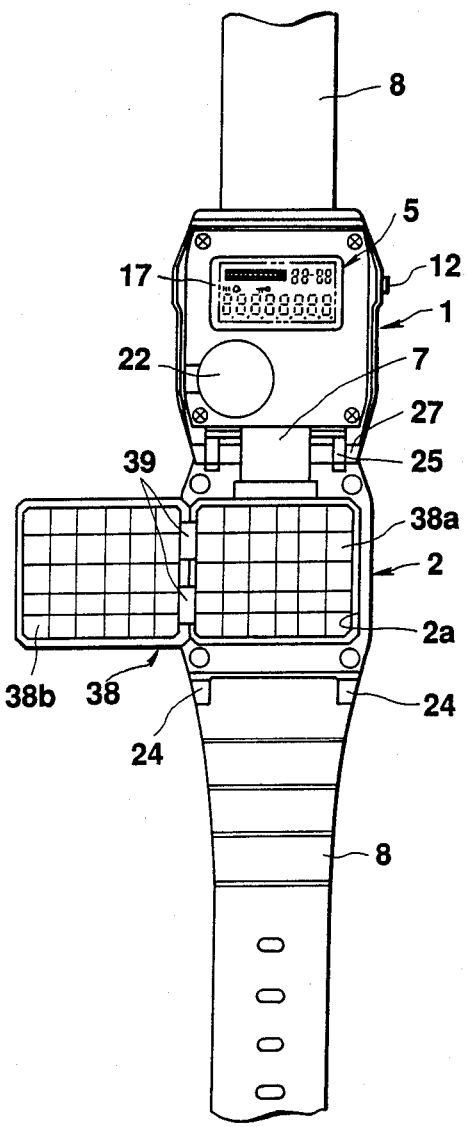
FIG. 10 is a plan view showing an electronic wrist watch according to a fourth embodiment of the present invention in a state wherein a case is open.

A fourth embodiment of the present invention will be described below with reference to FIG. 10. Similarly, the same reference numerals in the fourth embodiment denote the same parts as in the first embodiment, and a description thereof will be omitted.

In an electronic wristwatch of the fourth embodiment, a sheet switch 38 which is mounted on the upper surface of a plate 2 is designed to be laterally folded. The sheet switch 38 is constituted by two keyboards **38*a* and 38*b* which are coupled to each other through coupling members 39 so as to be freely opened and closed. Each of the keyboards 38*a* and 38*b* has an arrangement similar to that of the sheet switch 6 described above, and a large number of keys are arranged on each keyboard. The keyboards 38*a* and 38*b* are housed in a switch housing recess 2*a* of the plate 2 while they are stacked on each other. In this case, the keyboard 38*a* which is located at a lower position is fixed in a switch housing recess 2*a* and is electrically connected to a digital display section 5 of a case 1 through a flexible wiring board 7** in the same manner as in the first embodiment.

According to the above-described electronic wristwatch, the area of the sheet switch 38 can be further increased, and hence a larger number of keys can be arranged on the sheet switch 38, thereby increasing the number of data which can be input to a circuit 28 (FIG. 5). In the fourth embodiment, the sheet switch 38 is designed to be laterally folded in two. However, the sheet switch 38 may be designed to be folded in three or more.

A fifth embodiment of the present invention will be described below with reference to FIGS. 11 to 16. The same reference numerals in the fifth embodiment denote the same parts as in the first embodiment, and a description thereof will be omitted.

In this embodiment, a frame-like seal member 51 having the same shape as that of a coupling portion of upper and lower half cases 55 and 56 constituting a case 1 is formed at one end of a flexible wiring board 50 which electrically connects a sheet switch 41 to a circuit board 18 in the case 1. The seal member 51 is clamped between the upper and lower half cases 55 and 56 so as to waterproof the case 1.

In the sheet switch 41 the flexible wiring board 50 and the seal member 51 are integrally formed with each other, as shown in FIGS. 13 to 16.

The sheet switch 41 is constructed by stacking a protective sheet 42, a double-sided adhesive tape 43 of a synthetic resin sheet on both side surfaces of which adhesive is applied, a stationary contact sheet 44, a spacer 45, a movable contact sheet 46, a double-sided adhesive tape 47 of a synthetic resin sheet on both side surfaces of which adhesive is applied, and a face sheet 48 upward in the order named.

Frame portions 42*a*, 43*a*, 44*a*, 45*a*, 46*a*, 47*a*, and 48*a* constituting the seal member, and connecting portions 42*b*, 43*b*, 44*b*, 45*b*, 46*b*, 47*b*, and 48*b* constituting the flexible wiring board 50 are integrally formed with the protective sheet 42, the double-sided adhesive tape 43, the stationary contact sheet 44, the spacer 45, the movable contact sheet 46, the double-sided adhesive tape 47, and the face sheet 48.

In addition, protrusions 42*c*, 43*c*, 44*c*, and 46*c* protruding in a space enclosed within the frame portions are respectively formed on the protective sheet 42, the double-sided adhesive tape 43, the stationary contact sheet 44, and the movable contact sheet 46. The protrusion 46*c* of the movable contact sheet 46 is shorter than the other protrusions 42*c*, 43*c*, and 44*c*.

The protective sheet 42 and the face sheet 48 are made of a polyurethane resin. Key symbols such as a ten-key pad, function keys, and a mode key are printed on the upper surface of the face sheet 48. The double-sided adhesive tape 43 functions to adhere the protective sheet 42 and the stationary contact sheet 44 to each other, and the double-sided adhesive tape 47 functions to adhere the face sheet 48 and the movable contact sheet 46 to each other. The stationary and movable contact sheets 44 and 46 are made of a polyester resin. A plurality of stationary contacts 44*d* printed on the upper surface of the stationary contact sheet 44 by using carbon and a plurality of movable contacts 46*d* printed on the movable contact sheet 46 by using carbon oppose each other through openings 45*c* formed in the spacer 45.

The spacer 45 is constituted by a double-sided adhesive tape of a synthetic resin sheet on both side surfaces of which adhesive is applied. The sheet switch 41 is waterproofed by the spacer 45 functioning to adhere the stationary contact sheet 44 and the movable contact sheet 46 to each other.

The above-described sheet switch 41 is bonded to the upper surface of the plate 2 through a double-sided adhesive tape 49 of a synthetic resin sheet on both side surfaces of which adhesive is applied bonded to the lower surface of the protective sheet 42.

Figure 11:
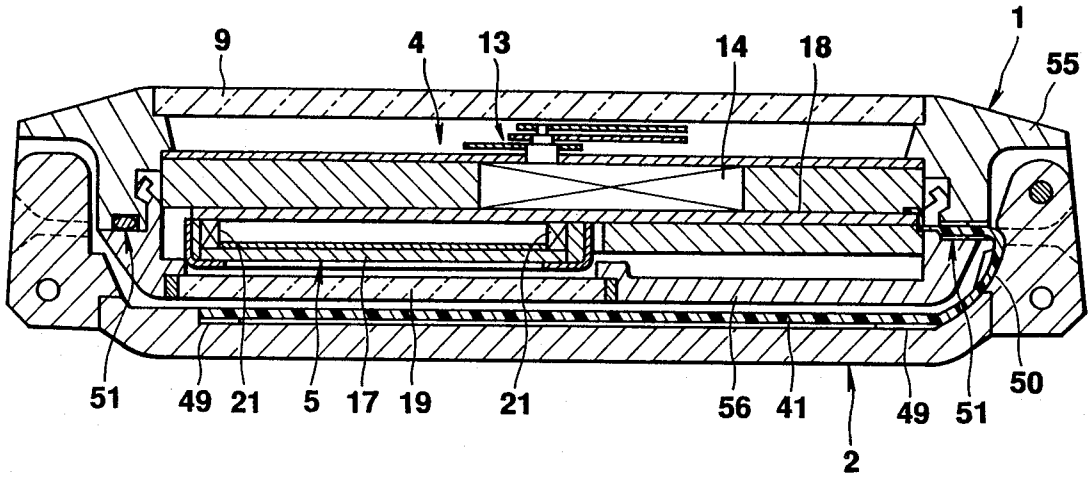
FIG. 11 is a sectional view showing a main part of an electronic wristwatch according to a fifth embodiment of the present invention in a state wherein a case is closed.
Figure 16:
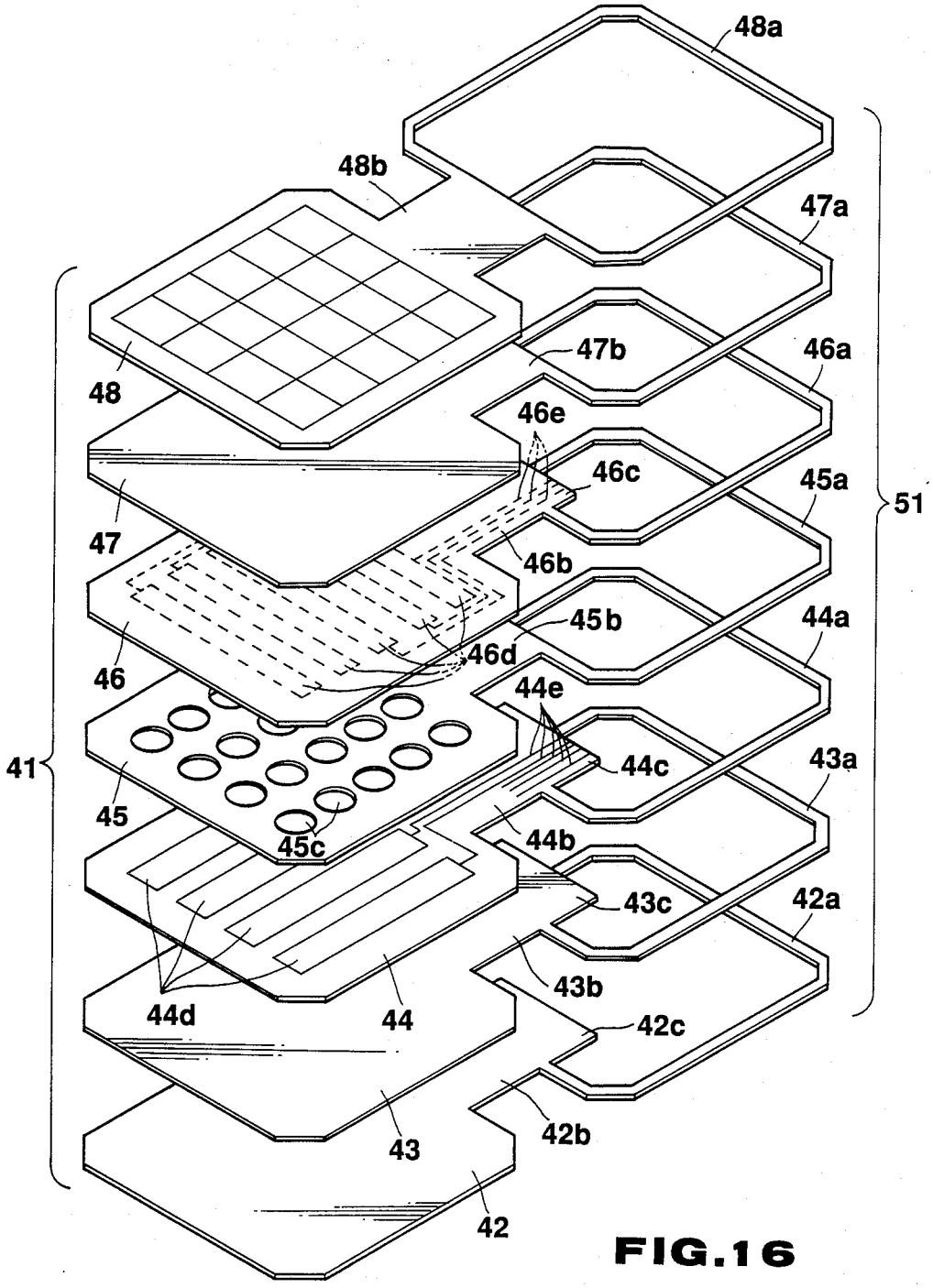
FIG. 16 is an exploded perspective view showing a sheet switch, a flexible wiring board, and a seal member of the electronic wristwatch in FIG. 11.

A plurality of leads 44*e* are printed on the connecting portion 44*b* and the protrusion 44*c* of the stationary contact sheet 44 by using carbon, as shown in FIG. 16. The stationary contacts 44*d* are electrically connected to the leads 44*e*, respectively. In addition, a plurality of leads 46*e* formed on the connecting portion 46*b* and the protrusion 46*c* of the movable contact sheet 46 are respectively connected to the leads 44*e* by using a conductive adhesive agent. End portions of the leads 44*e* are respectively connected to terminals of a circuit board 18. With this arrangement, the stationary and movable contacts 44*d* and 46*d* are electrically connected to an electronic circuit 28 (FIG. 11).

Figure 12:
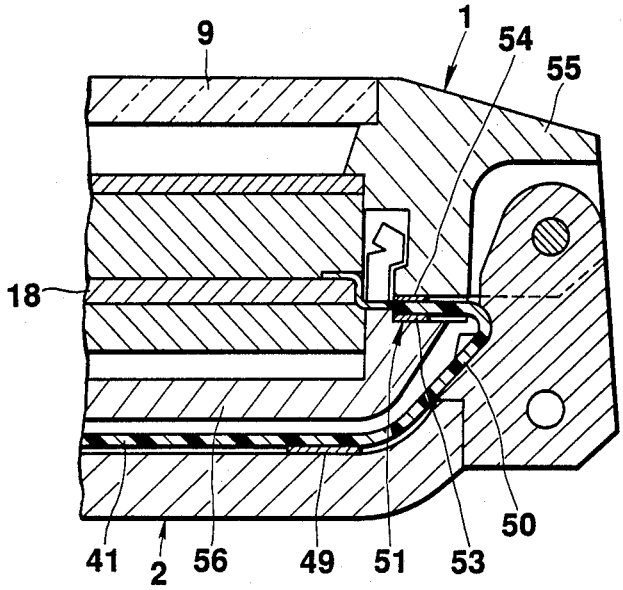
FIG. 12 is an enlarged view showing a main part of the electronic wristwatch in FIG. 11.
Figure 13:
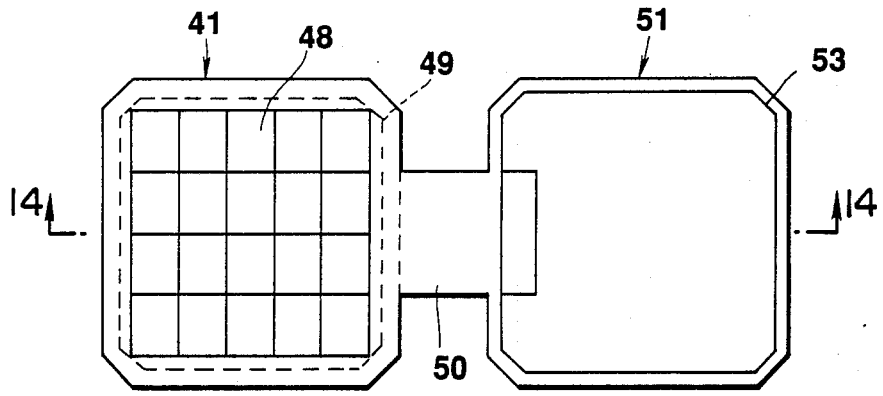
FIG. 13 is a plan view showing a sheet switch, a flexible wiring board, and a seal member of the electronic wristwatch in FIG. 11.
Figure 14:
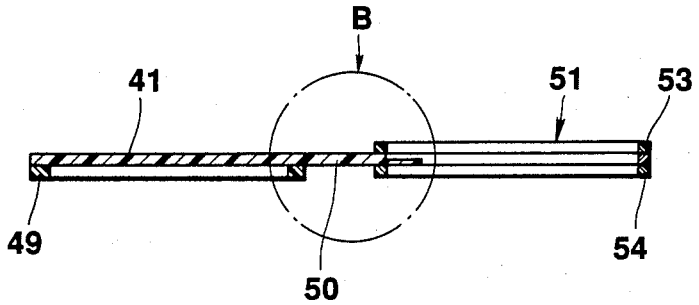
FIG. 14 is a sectional view taken along a line A—A in FIG. 13.
Figure 15:
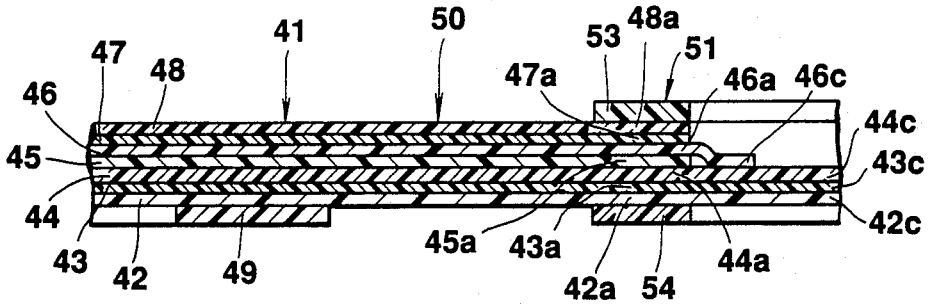
FIG. 15 is an enlarged sectional view showing a portion enclosed within an alternately lone and dashed line B in FIG. 14.

Waterproof double-sided adhesive tapes 53 and 54 each having the same shape as that of the seal member 5 are of synthetic resin sheets on each both side surfaces of which adhesive is applied, and are respectively bonded to the upper and lower surfaces of the seal member 51. As shown in FIG. 12, the seal member 51 is clamped between the upper and lower half cases 55 and 56 in a reversed state, while one waterproof double-sided adhesive tape 54 is bonded to the lower surface of the upper half case 55, and the other waterproof double-sided adhesive tape 53 is bonded to the upper surface of the lower half case 56. As a result, the upper and lower half cases 55 and 56 are bonded to each other, and a coupling portion thereof is water-tightly sealed.

In the above-described embodiment, since the seal member 51 used for the coupling portion of the upper and lower half cases 55 and 56 of the case 1 is integrally formed with the flexible wiring board 50, an independent manufacturing step for the seal member 51 is not required, and attachment of the seal member 51 to the case 1 is facilitated.

Note that a waterproof function of the seal member 51 may also be realized by bonding a waterproof elastic member such as silicone rubber to a surface or surfaces of one or both of the waterproof double-sided adhesive tapes 53 and 54, or by forming a waterproof elastic member such as silicone rubber by printing or the like in place cf one or both of the tapes 53 and 54.

A sixth embodiment of the present invention will be described below with reference to FIGS. 17 and 18. The same reference numerals in the sixth embodiment denote the same parts as in the first embodiment, and a description thereof will be omitted.

In the sixth embodiment, a case 1 is attached to a plate 2 through pins 3 so as to be freely opened and closed. The case 1 can be locked to a closing position by using a lock/switch mechanism 61.

Figure 17:
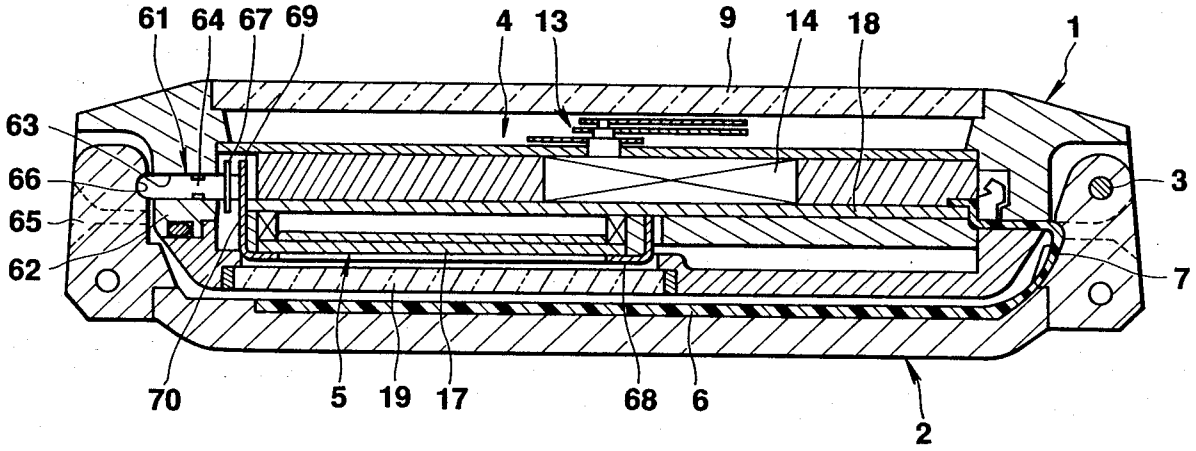
FIG. 17 is a sectional view showing an electronic wristwatch according to a sixth embodiment of the present invention in a state wherein a case is closed.
Figure 18:
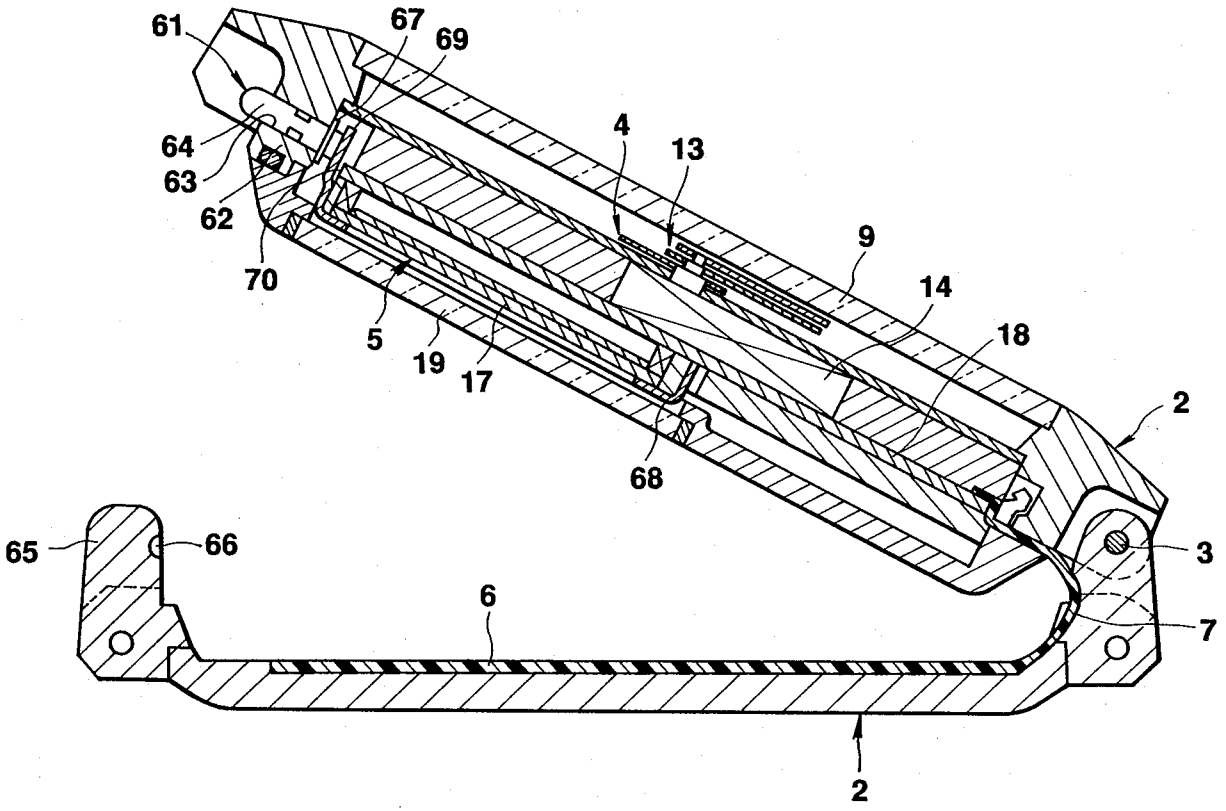
FIG. 18 is a sectional view showing a main part of the electronic wristwatch in FIG. 17 in a state wherein the case is half open.
Figure 19:
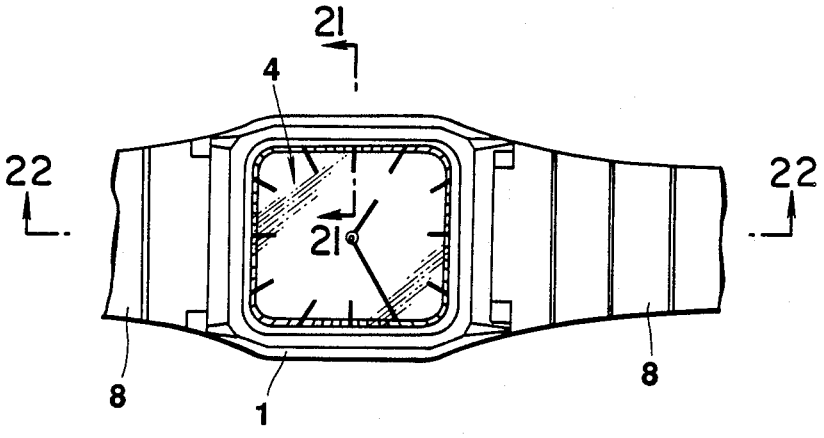
FIG. 19 is a plan view showing an electronic wristwatch according to a seventh embodiment in a state where a case is closed.
Figure 20:
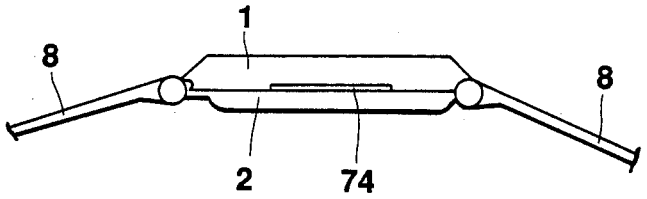
FIG. 20 a side view of the electronic wristwatch in FIG. 19.
Figure 21:
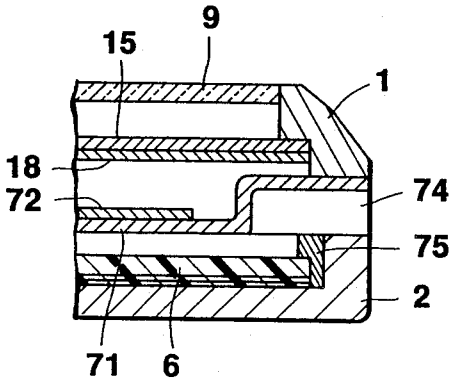
FIG. 21 is a sectional view taken along a line A—A of the electronic wristwatch in FIG. 19.

The lock/switch mechanism 61 comprises a movable member 64 which is slidably inserted in an insertion hole 63 formed in a wall portion 62 of the case 1 located at the left side in FIG. 17. The distal end portion of the movable member 64 which extends outward from the wall portion 62 has a hemispherical shape. An engaging portion 66 constituted by a hemispherical recess is formed in a wall portion 65 of the plate 2 located at the left side in FIG. 17 so as to correspond to the hemispherical end portion of the movable member 64. A flange-like stopper 67 is mounted on the proximal end portion of the movable member 64 which extends inward from the wall portion 62 of the case 1. A movable contact spring portion 69 which is constituted by part of a panel press plate 68 for fixing a liquid crystal display panel 17 is arranged at a position to oppose the proximal end face of the movable member 64 in the case 1. A stationary contact 70 is mounted on an end face cf a circuit board 18 which opposes the movable contact spring portion 69. Note that the lock/switch mechanism 61 is used to ON/OFF-control the liquid crystal display panel 17 of a digital display section 5. While the spring portion 69 is in contact with the stationary contact 70, the display panel 17 is turned off. While they are separated from each other, the display panel 17 is turned on. The panel press plate 68 is constituted by a conductive metal plate, and is connected to a reference voltage.

In the electronic wristwatch having the above-described arrangement, when the case 1 is moved to the closing position, the distal end portion of the movable member 64 is engaged with and urged by the engaging portion 66 of the plate 2, as shown in FIG. 17. Upon engagement of the movable member 64 with the engaging portion 66, the case 1 is locked to the plate 2. In addition, since the movable member 64 is urged by the engaging portion 66, the movable contact spring portion 69 is urged by the proximal end face of the movable member 64. As a result, the spring portion 69 is elastically deformed and is brought into contact with the stationary contact 70 of the circuit board 18. In this state, supply of a drive signal from the circuit board 18 to the liquid crystal display panel 17 is stopped, and hence the display panel 17 is set in an inoperative state. In this case, since the watch function of the circuit board 18 continues, hands 13 of an analog display section 4 are continuously moved. Therefore, display of time by means of the analog display section 4 is continuously performed.

In this electronic wristwatch, when the case 1 is moved to the opening state, engagement of the distal end portion of the movable member 64 of the case 1 with the engaging portion 66 of the plate 2 is released, and the movable contact spring portion 69 moves away from the stationary contact 70 of the circuit board 18 due to its own biasing force Since the movable member 64 is urged by the spring portion 69, the stopper 67 is brought into contact with the inner surface of the wall portion 62 of the case 1. In this state, supply of a drive signal from the circuit board 18 to the liquid crystal display panel 17 is started, and the display panel 17 displays data corresponding to a mode selected by a mode key of a sheet switch 6.

In this electronic wristwatch, since ON/OFF control of the liquid crystal display panel 17 of the digital display section 5 is performed in accordance with an opening/closing operation of the case 1, a power-saving effect can be obtained, thus prolonging the service life of a battery for driving the electronic wristwatch.

In this electronic wristwatch, since the movable contact spring portion 69 constituted by a part of the panel press plate 68 for fixing the liquid crystal display panel 17 constitutes the ON/OFF switch of the display panel 17 together with the stationary contact 70 of the circuit board 18, and also serves as a spring for biasing the movable member 64 toward the lock direction, a space required for forming lock and switch mechanisms can be saved. In addition, the cost of the electronic wristwatch can be decreased.

A seventh embodiment of the present invention will be described below with reference to FIGS. 19 to 24. The same reference numerals in the seventh embodiment denote the same parts as in the first embodiment, and a description thereof will be omitted.

In this embodiment, in order to obtain a sufficient alarm sound with a simple arrangement, a piezoelectric element 72 is bonded to a lower half case 71 of a case 1 which is arranged on a side opposing a plate 2, and notches 74 for producing an alarm sound to the outside are formed in portions of a bonding surface between the case 1 and the plate 2.

Figure 22:
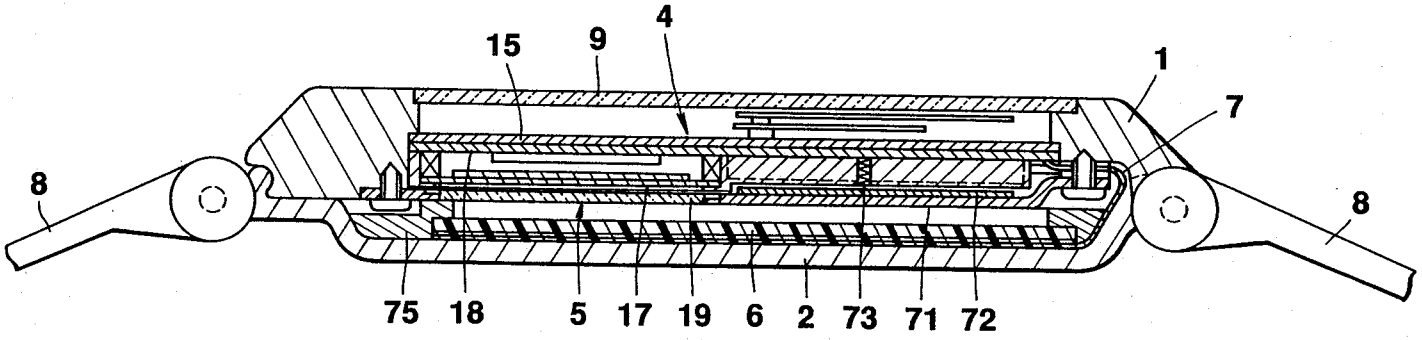
FIG. 22 is a sectional view taken along a line B—B of the electronic wristwatch in FIG. 19.
Figure 23:
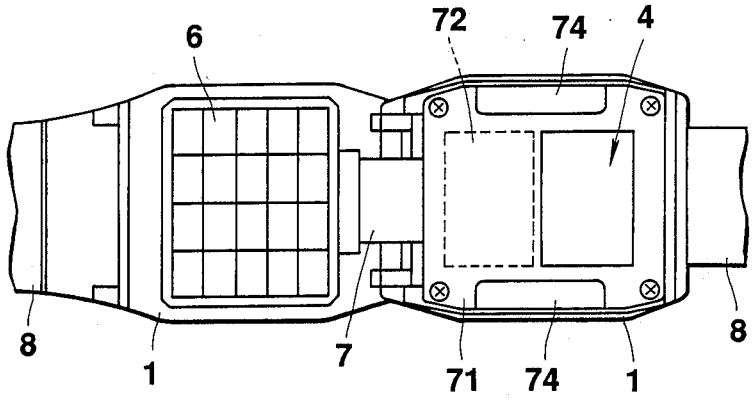
FIG. 23 is a plan view showing the electronic wristwatch in FIG. 19 in a state wherein the case is open.
Figure 24:
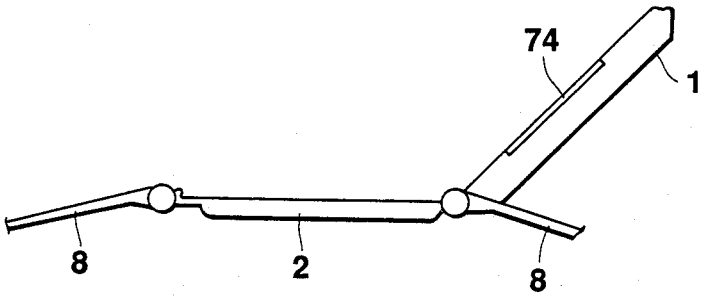
FIG. 24 is a side view showing the electronic wristwatch in FIG. 19 in a state wherein the case is open.

The piezoelectric element 72 is bonded to the upper surface of the lower half case 71 (at a right end portion in FIG. 22). The upper surface of the piezoelectric element 72 is electrically connected to a sound generating Circuit of a circuit board 18 through a coil spring 73, and the lower surface of the element 72 is connected to a reference voltage through the lower half case 71 constituted by a conductive metal plate. The notches 74 are respectively mounted in the left and right end portions of the lower surface of the plate 2. Note that the notches 74 may not be mounted in the case 1 but may be mounted in the plate 2. Alternatively, the notches 74 may be mounted at symmetrical positions of the case 1 and the plate 2. In addition, a sheet switch 6 is attached to the upper surface of the plate 2 with a stationary member 75.

In this electric wristwatch, when the case 1 is moved to a closing position, only an analog display section 4 is exposed, as shown in FIGS. 19 to 22. When the case 1 is moved to an opening position, a digital display section 5 and the sheet switch 6 are exposed.

In addition, in this electronic wristwatch, if the piezoelectric element 72 is operated upon reception of a drive signal from the sound generating circuit of the circuit board 18 while the case 1 is closed as shown in FIGS. 19 to 22, the lower half case 71 to which the piezoelectric element 72 is bonded is oscillated to generate an alarm sound. The alarm sound is then produced outside the case 1 through the two notches 74.

When this electronic wristwatch is attached to an arm of a user, since the piezoelectric element 72 is not bonded to the plate 2 which is in tight contact with the arm, but is bonded to the lower half case 71 which is not in tight contact with the arm, oscillation of the lower half case 71 is not suppressed by the arm. In addition, an alarm sound generated by oscillation of the lower half case 71 is produced outside the case 1 through the two notches 74. Therefore, in this electronic wristwatch, a sufficient alarm sound can be obtained with a simple arrangement. Furthermore, in this electronic wristwatch, when the case 1 is to be opened, since a user can rest his fingers on the notches 74, the case 1 can be easily moved from the closing position to the opening position.

An eighth embodiment of the present invention will be described below with reference to FIGS. 25 to 27. The same reference numerals in the eighth embodiment denote the same parts as in the first embodiment, and a description thereof will be omitted.

In this embodiment, in order to facilitate battery replacement or maintenance, analog and digital display sections 5 and 4 are respectively formed into units, and are detachably coupled to each other.

In the eighth embodiment, a case 1 is constituted by upper and lower half cases 81 and 82 which are coupled to each other with screws 83, and is attached to a plate 2 so as to be freely opened and closed. The analog display section 4 is housed in the upper half case 81. A cover 84 is fixed to the inner surface of the upper half case 81 with screws 85. The digital display section 5 is housed in the lower half case 82, and a cover is fixed to the inner surface of the lower half case 82 with screws 87.

In this embodiment, a battery 88 is arranged between a circuit board 18 and a cover 86 at a position away from a pin 89. An analog movement 14 of the analog display section 4 is arranged in the upper half case 81 at a position near the pin 89. A portion of the cover 86 of the digital display section 5 in the lower half case 82 corresponding to the battery 88 protrudes from other portions of the cover 86. A portion of the cover 84 of the analog display section 4 corresponding to the analog movement 14 protrudes from other portions of the cover 84. With this arrangement, even if the upper and lower half cases 81 and 82 are coupled to each other with the screws 83, the protrusion of the cover 86 of the lower half case 82 and the protrusion of the cover 84 of the upper half case 86 do not interfere with each other. This contributes to a reduction in profile of the case 1, and hence contributes to a reduction in profile of the electronic wristwatch.

Figure 25:
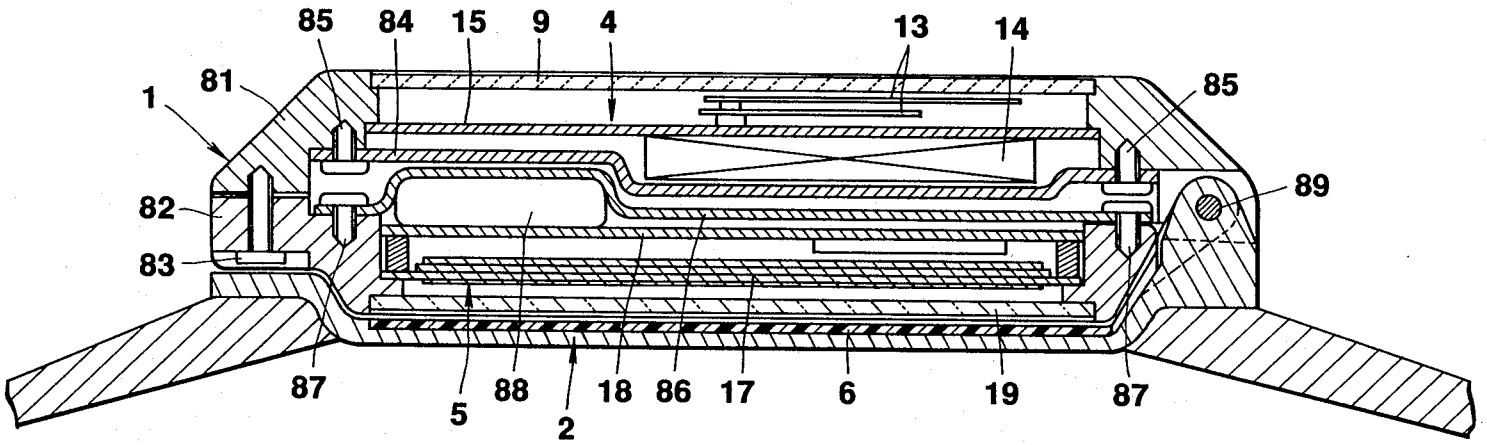
FIG. 25 is a sectional view showing a main part of an electronic wristwatch according to an eighth embodiment of the present invention in a state wherein upper and lower half cases which are coupled to each other are located at a closing position.

In this electronic wristwatch, when the case 1 consisting of the upper and lower half cases 81 and 82 which are coupled to each other with the screws 83 is moved to the closing position, only the analog display section 4 is exposed, as shown in FIG. 25. When the case 1 is moved to the opening position, the digital display section 4 and the sheet switch 6 are exposed, as shown in FIG. 26.

Figure 26:
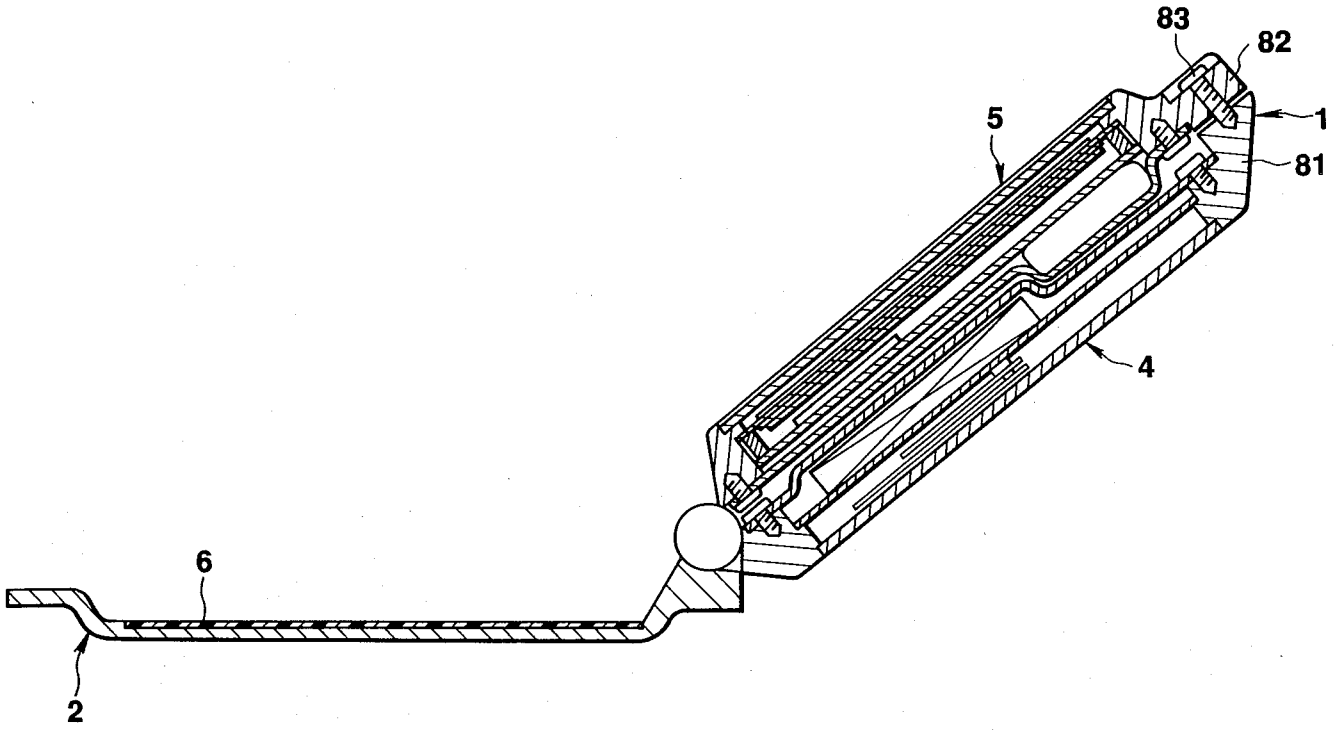
FIG. 26 is a sectional view showing a main part of the electronic wristwatch in FIG. 25 in a state wherein the upper and lower half cases which are coupled to each other are located at an opening position.

When the battery 88 in the electronic wristwatch is to be replaced with a new one, the case 1 is moved to the opening position, as shown in FIG. 26. As a result, the screws 83 used to couple the upper and lower half cases 81 and 82 to each other are exposed. The screws 83 are unfastened to release coupling of the upper and lower half cases 81 and 82. Thereafter, when only the lower half case 82 is pivoted toward the plate 2, the screws 87 used to fix the cover 86 to the lower half case 82 are exposed, as shown in FIG. 27. The exposed screws 87 are then unfastened to detach the cover 86 from the lower half case 82. As a result, the battery 88 is exposed. When the battery 88 is replaced with a new one, the above-described operation is performed in a reverse order Finally, the upper and lower half cases 81 and 82 are coupled to each other with the screws 83, thus completing the battery replacement.

Figure 27:
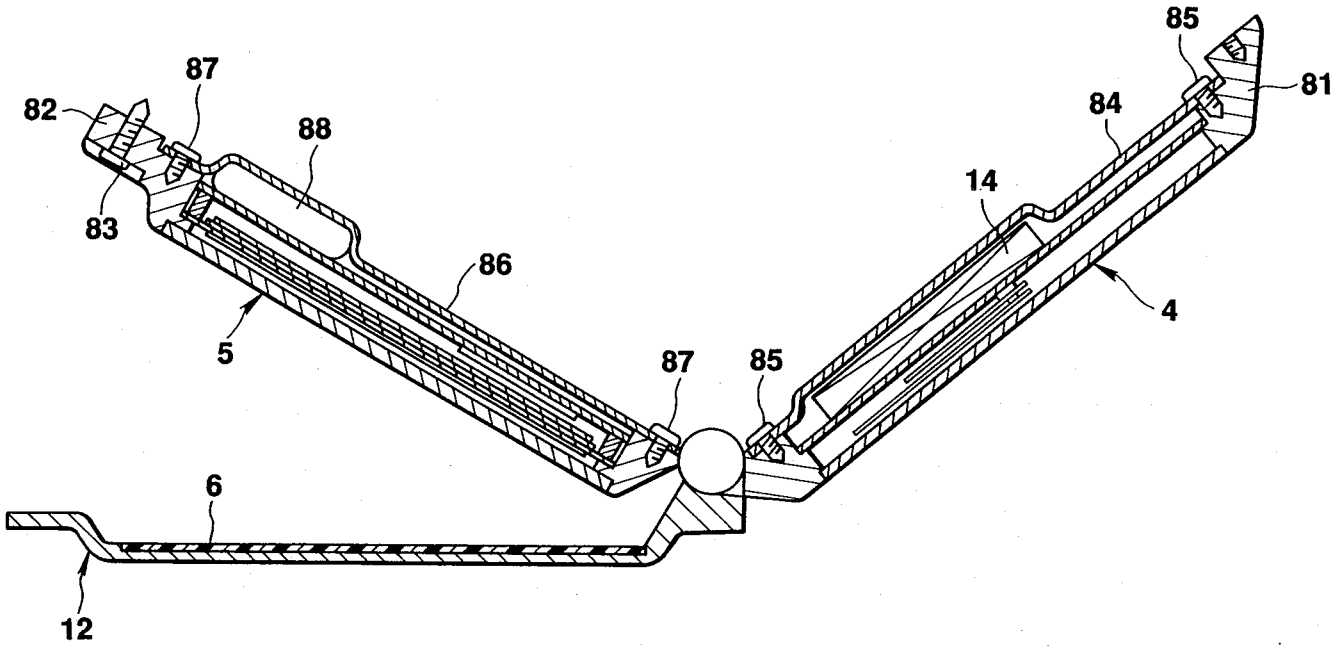
FIG. 27 is a sectional view showing a main part of the electronic wristwatch in FIG. 25 in a state wherein the upper and lower half cases are separated from each other at the opening position.

In this electronic wristwatch, when the analog movement 14 is to be repaired, the screws 83 are unfastened in the same manner as in the battery replacement procedure so as to set the wristwatch in the state shown in FIG. 27. When the cover 84 is detached from the upper half case 81 by unfastening the screws 85 which are exposed on the inner surface of the upper half case 81, the analog movement 14 can be exposed. Upon completion of repair of the analog movement 14, the above-described operation is performed in a reverse order. Finally, the upper and lower half cases 81 and 82 are coupled to each other with the screws 83, thus completing the repair of the analog movement 14.

As described above, in this electronic wristwatch, when the battery 88 is to be replaced with a new one or the analog movement 14 is to be repaired, the upper and lower half cases 81 and 82 are separated from each other by unfastening the screws 83. Thereafter, the screws 87 or 85 are unfastened to detach the cover 86 or 84 from the lower or upper half case 82 or 81. With this simple operation, battery replacement or maintenance of the analog movement 14 can be facilitated.

That is, in this embodiment, the analog and digital display sections 4 and 5 are respectively housed as discrete units in the upper and lower half cases 81 and 82, and moreover both the units are detachably coupled to each other with the screws 83. Therefore, if both the units are separated from each other by unfastening the screws 83, each unit can be independently disassembled or assembled. This facilitates disassembly and assembly of the case 1 required for battery replacement or repair of the analog movement 14.

A ninth embodiment of the present invention will be described below with reference to FIGS. 28 and 29. The same reference numerals in the ninth embodiment denote the same parts as in the first embodiment, and a description thereof will be omitted.

In this embodiment, two press projections are mounted on the lower surface of a case 1 so as to correspond to two specific keys on a sheet switch. When the case 1 is moved to a closing position, the two press projections depress the two specific keys on the sheet switch. When the two specific keys are simultaneously depressed, a digital display section is turned off to reduce current consumption of an electronic wristwatch.

Figure 28:
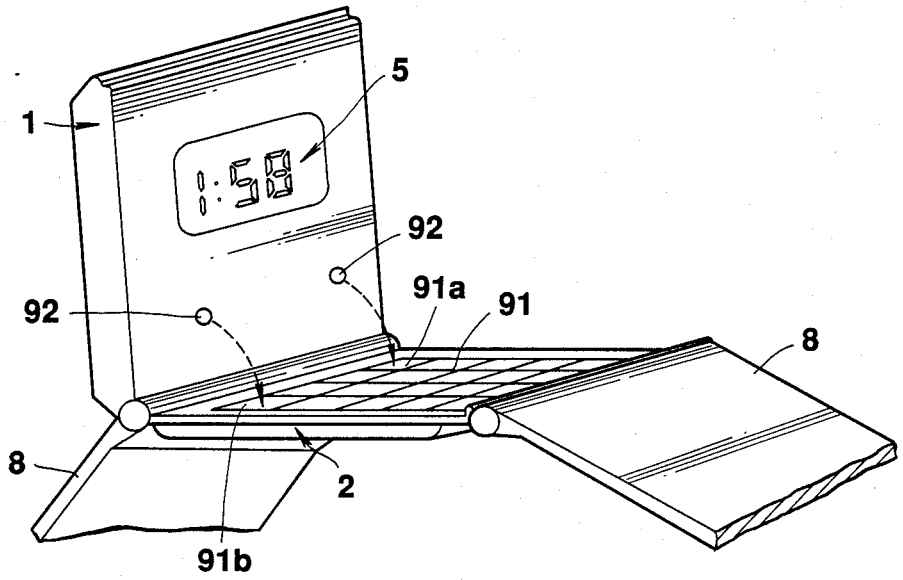
FIG. 28 is a perspective view showing a main part of an electronic wristwatch according to a ninth embodiment of the present invention.

FIG. 28 is a perspective view showing an electronic wristwatch according to the ninth embodiment, in which an upper half case is moved to a opening position Two projections 92 are mounted, on a surface of the case 1, which is stacked on a plate 2, at positions respectively corresponding to two keys **91*a* and 91*b* of a sheet switch 91. When the case 1 is moved to the closing position, the pair of projections 92 depress the two keys 91*a* and 91*b* of the sheet switch 91**.

Figure 29:
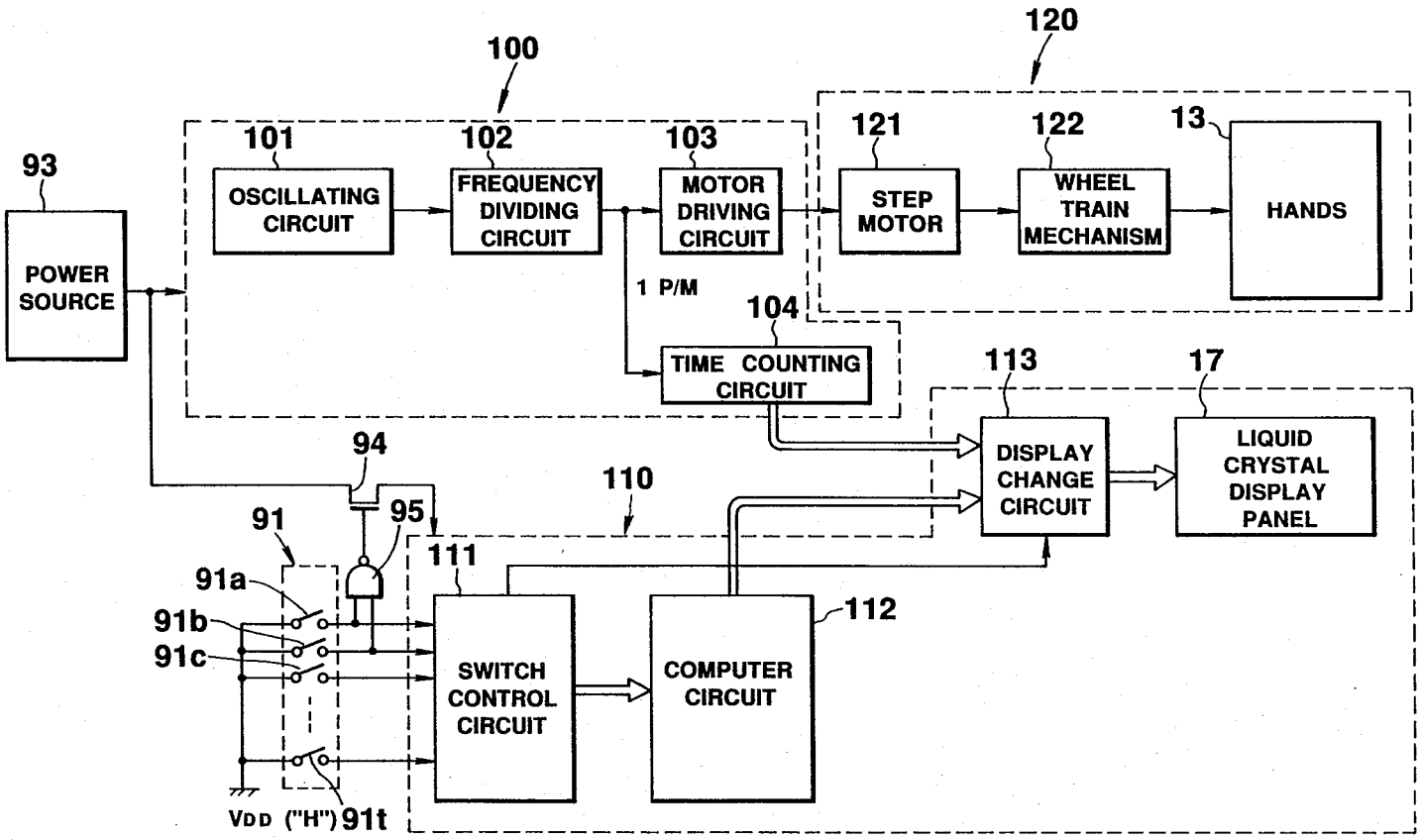
FIG. 29 is a block diagram showing a circuit arrangement of the electronic wristwatch in FIG. 28.

FIG. 29 shows a schematic arrangement of a circuit of the ninth embodiment The circuit is substantially constituted by a power source 93, a timer section 100 and a display/calculation circuit 110 for receiving power from the power source 93, a switching transistor 94 arranged on a power source supply line to the display/calculation circuit 110, a NAND gate 95 for supplying a gate signal to the switching transistor 94, a sheet switch 91, and a hand driving section 120 for driving hands to display time upon reception of a signal from the timer section 100.

In the timer section 100, current time is obtained by causing a time counting circuit 104 to count one frequency-divided IP/M signal obtained by frequency-dividing a signal of a predetermined frequency output from an oscillating circuit 101 by using a frequency dividing circuit 102. Upon reception of the IP/M signal, a motor driving circuit 103 outputs a drive signal to a step motor 121.

The hand driving section 120 transmits rotation of the step motor 121, which is driven by the output from the motor driving circuit 103, to hands 13 through a wheel train mechanism 122 so as to drive the hands 13 to display time.

The sheet switch 91 includes 20 key switches **91*a* to 91*t* whose movable contacts are set at a constant voltage VDD (H level). The stationary contacts of the key switches 91*a* to 91*t* are connected to a switch control circuit 111. The stationary contacts of the key switches 91*a* and 91*b* are further connected to the input terminals of the NAND gate 95**.

The display/calculation circuit 110 includes the switch control circuit 111, a computer circuit 112, a display change circuit 113, and the above-described liquid crystal display panel 17. Upon operation of the key switches **91*a* to 91*t*, the switch control circuit 111 supplies input data to the computer circuit 112, and at the same time supplies a display change signal d to the display change circuit 113. The computer circuit 112 performs a calculation on the basis of the data input from the switch control circuit 111 and supplies the calculation result to the display change circuit 113. The display change circuit 113 fetches the current time from the time counting circuit 104 and the calculation result from the computer circuit 112, and supplies either of them to the liquid crystal display panel 17 in accordance with a display change signal d from the switch control circuit 111. The display panel 17** performs a digital display of the supplied current time or calculation result.

An operation of the ninth embodiment having the above-described arrangement will be described below.

When the case 1 is moved to the opening position as shown in FIG. 28, the two key switches 91*a* and 91*b* of the sheet switch 91 shown in FIG. 28 are not simultaneously depressed by the pair of projections 92 on the lower surface of the case 1. That is, either of the two switches 91*a* and 91*b* is operated or neither of them are operated. Therefore, an output from the NAND gate 95 is always set at H level, and power is continuously supplied to the display/calculation circuit 110 through the switching transistor 94. As a result, current time or a calculation result from the display change circuit 113 is displayed on the liquid crystal display panel 17.

When the case 1 is moved to the closing position, the two key switches 91*a* and 91*b* of the sheet switch 91 are simultaneously depressed by the two projections 92 on the lower surface of the case 1. Referring to FIG. 29, when the two key switches 91*a* and 91*b* of the sheet switch 91 are simultaneously depressed and turned on, an output from the NAND gate 95 is set at L level, and hence the switching transistor 94 is set in an OFF state. As a result, since no power is supplied from the power source 93 to the display/calculation circuit 110, the operation of display/calculation circuit 110 is stopped, and no data display is performed by the liquid crystal data display panel 17, thus preventing unnecessary power consumption of the power source 93. In a small electronic device which can display addresses on the liquid crystal data display panel 17 in addition to current time and a calculation result, while the case 1 is set at the opening position, addresses, for example, are displayed on the display panel 17. In such a device, its circuit may be arranged such that when the case 1 is moved to the opening position after it is moved to the closing position, current time is always displayed on the display panel 17.

Figure 30:
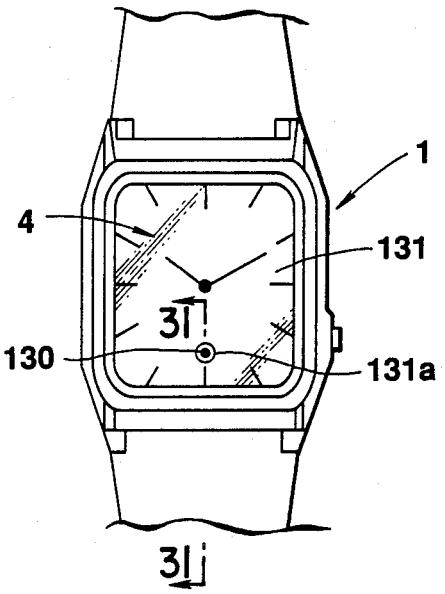
FIG. 30 is a plan view showing a main part of an electronic wristwatch according to a tenth embodiment of the present invention.

A tenth embodiment of the present invention will be described below with reference to FIGS. 30 to 32. The same reference numerals in the tenth embodiment denote the same parts as in the first embodiment, and a description thereof will be omitted.

In this embodiment, data which is displayed on a digital display section 5 can be seen from an analog display section 4.

Figure 31:
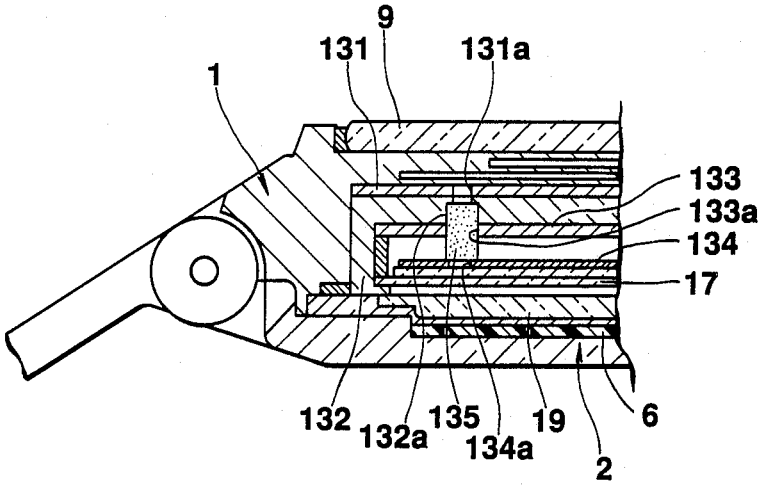
FIG. 31 is a sectional view taken along a line A—A in FIG. 30.
Figure 32:
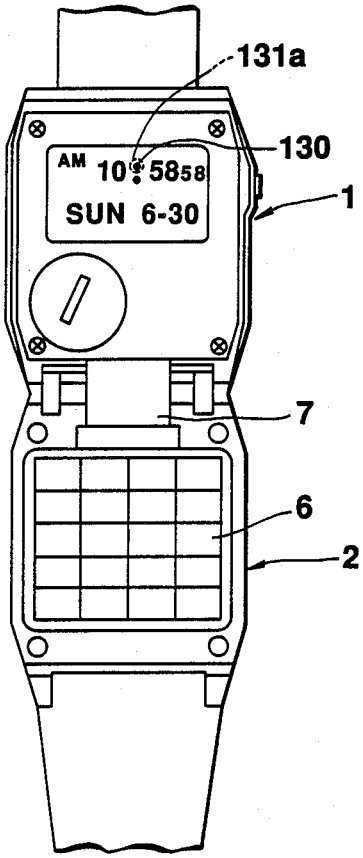
FIG. 32 is a plan view showing a main part of the electronic wristwatch in FIG. 30 in a state wherein a case is open.

As shown in FIG. 31, in this embodiment, an opening 131*a* is formed in a dial plate 131 of the analog display section 4 so as to correspond to a colon display element 130 which is turned on and off at a period of one second of a liquid crystal data display panel 17 of the digital display section 5. Openings 132*a* and 133*a* are respectively formed in a housing 132 and a circuit board 133 located below the dial plate 131 so as to correspond to the opening 131*a* of the dial plate 131. In addition, an opening 134*a* is formed in a reflecting plate 134 attached to the display panel 17 so as to correspond to the openings 132*a* and 133*a*. These openings 131*a*, 132*a*, and 133*a* constitute a path between the dial plate 131 and the display panel 17, and a lens 135 is arranged in the path. With this arrangement, even while a case 1 is moved to a closing position, the colon display element 130 displayed on the display panel 17 can be seen through the opening 131*a* of the dial plate 131, as shown in FIG. 30. For this reason, even in a two-hand type watch without a second hand, i.e., having only hour and minute hands, it can be immediately confirmed from one-second-period turning on/off of the colon display element 130 that the watch is operated.

Note that the opening 131*a* of the dial plate 131 may be enlarged so as to allow a character or numeral display portion in the liquid crystal data display panel 17 to be seen through the opening 131*a* so that even while the case 1 is set at the closing position, data such as a date, a schedule, or a telephone number can be seen from the analog display section 4.

Figure 33:
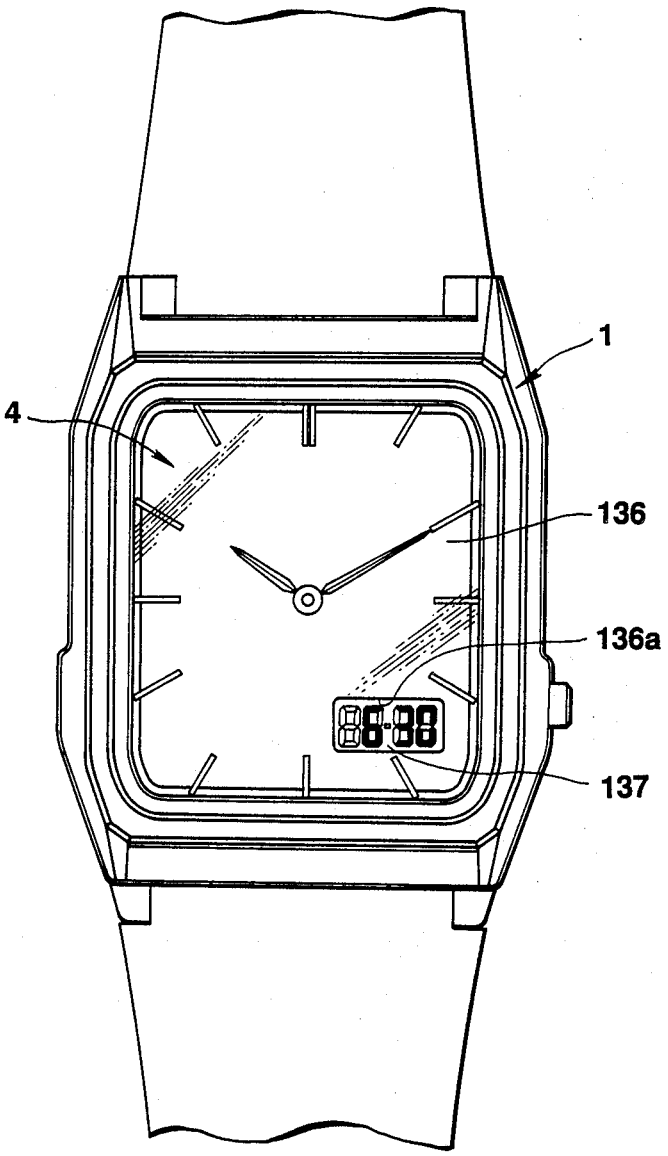
FIG. 33 is a plan view showing a modification of the electronic wristwatch of the tenth embodiment in a state wherein a case is closed.
Figure 34:
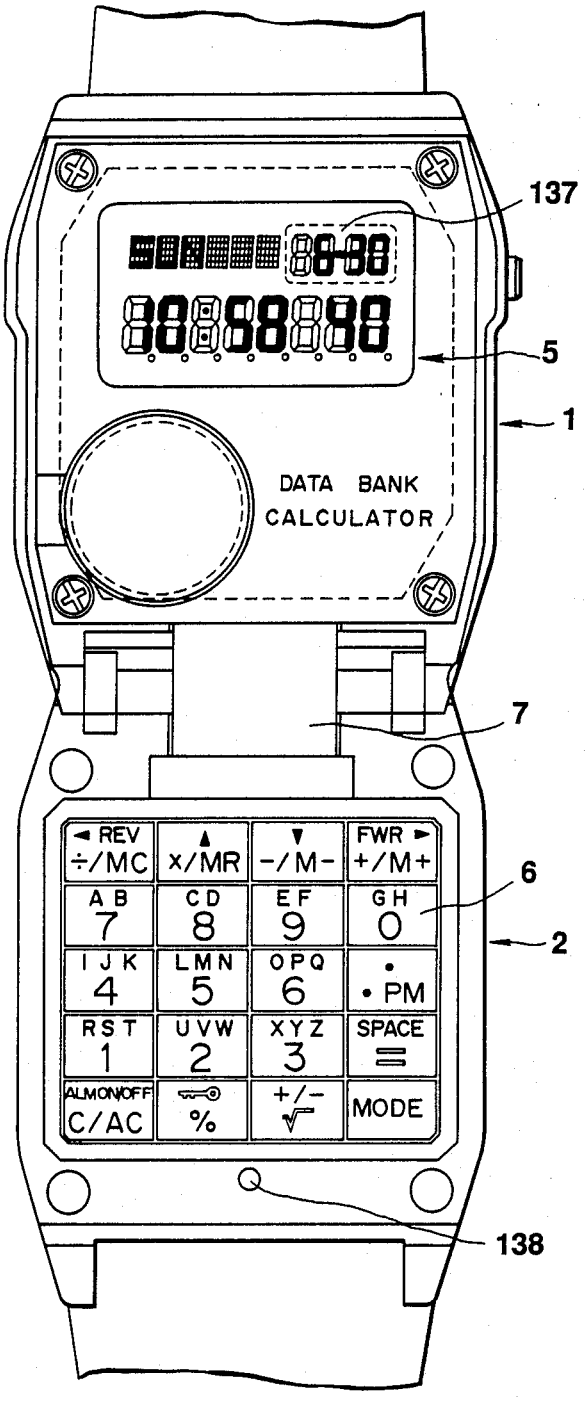
FIG. 34 is a plan view showing the electronic wristwatch in FIG. 33 in a state wherein the case is open.

FIGS. 33 and 34 show a modification of the tenth embodiment. In this modification, an opening 136*a* is formed in a dial plate 136 so as to correspond to a 4-digit numeral display element 137 of a liquid crystal data display panel 17 of a digital display section 5. Even if a case 1 is moved to a closing position, the 4-digit display element 137 can be seen through the opening 136*a* of the dial plate 136. As shown in FIG. 33, even while the case 1 is set at the closing position, a date on the digital display section 5 can be seen. In this case, the vertical and lateral positions of the numeral display element 137 seen from the analog display section 4 while the case 1 is set at the closing position are reversed with respect to those of the numeral display element 137 seen on the digital display section 5 while the case 1 is set at an opening position. For this reason, a photosensor 138 on a plate 2 detects whether the case 1 is moved to the closing position so as to automatically change the vertical and lateral positions of each digit displayed on the numeral display element 137.

An eleventh embodiment of the present invention will be described below with reference to FIGS. 35 to 43. The same reference numerals in the eleventh embodiment denote the same parts as in the first embodiment, and a description thereof will be omitted.

In this embodiment, analog and digital display sections 4 and 5 are respectively arranged on the upper and lower surfaces of a case 1, and an electronic circuit is arranged in the case 1. The case 1 is fixed to the 3- or 9-o'clock side of a plate 2 so as to be freely opened and closed. A sheet switch 6 is mounted on the upper surface of the plate 2. Similar to the above-described embodiments, the sheet switch 6 of the plate 2 and the electronic circuit are electrically connected to each other through a flexible wiring board 7 which extends at a coupling portion between the plate 2 and the case 1. Therefore, a structure for electrically connecting the sheet switch 6 of the plate 2 to the electronic circuit of the case 1 can be simplified.

In this electronic timepiece, the case 1 is attached to the 9-o'clock side of the plate 2 through a pin 140 so as to be freely opened and closed. The case 1 can be locked to a closing position by using a lock mechanism (not shown).

Figure 35:
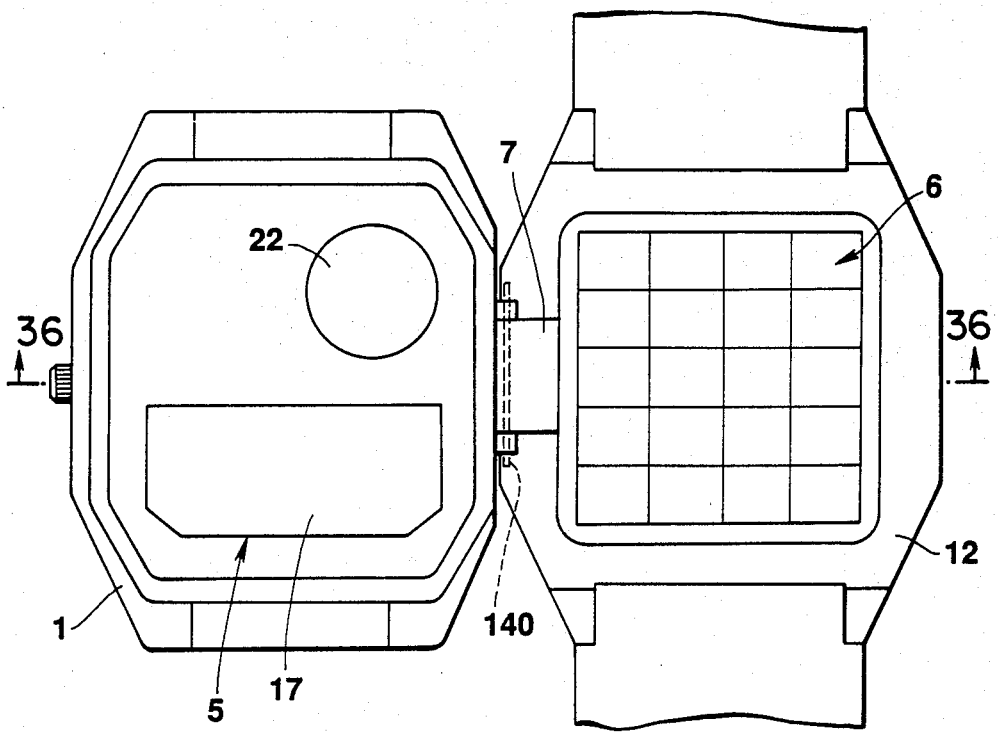
FIG. 35 is a plan view showing a main part of an electronic wristwatch according to an eleventh embodiment of the present invention.
Figure 36:
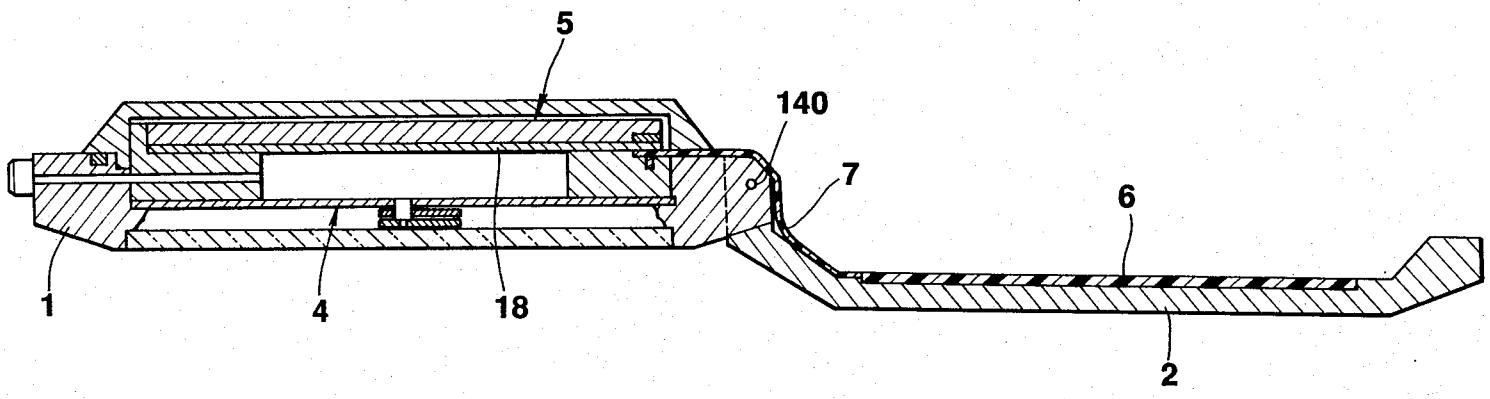
FIG. 36 is a sectional view taken along a line A—A of the electronic wristwatch in FIG. 35.
Figure 37:
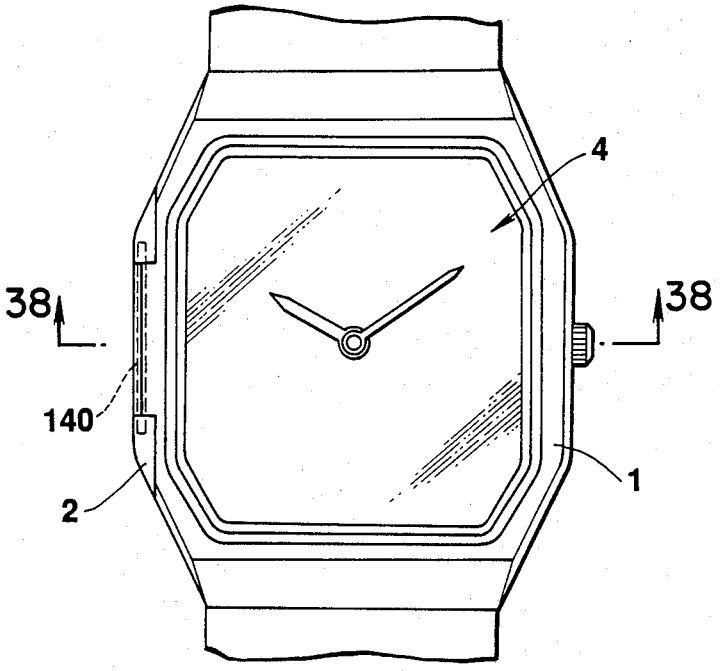
FIG. 37 is a plan view showing a main part of the electronic wristwatch in FIG. 35 in a state wherein the case is closed.
Figure 38:
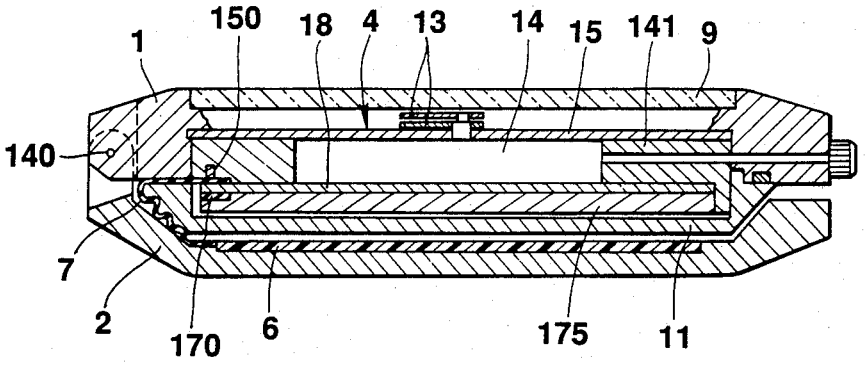
FIG. 38 is a sectional view taken along a line B—B in FIG. 37.

When the case 1 is set at the closing position, only the analog display section 4 is exposed, as shown in FIGS. 37 and 38. When the case 1 is set at an opening position, the digital display section 5 and the sheet switch 6 are exposed, as shown in FIGS. 35 and 36.

Figure 39:
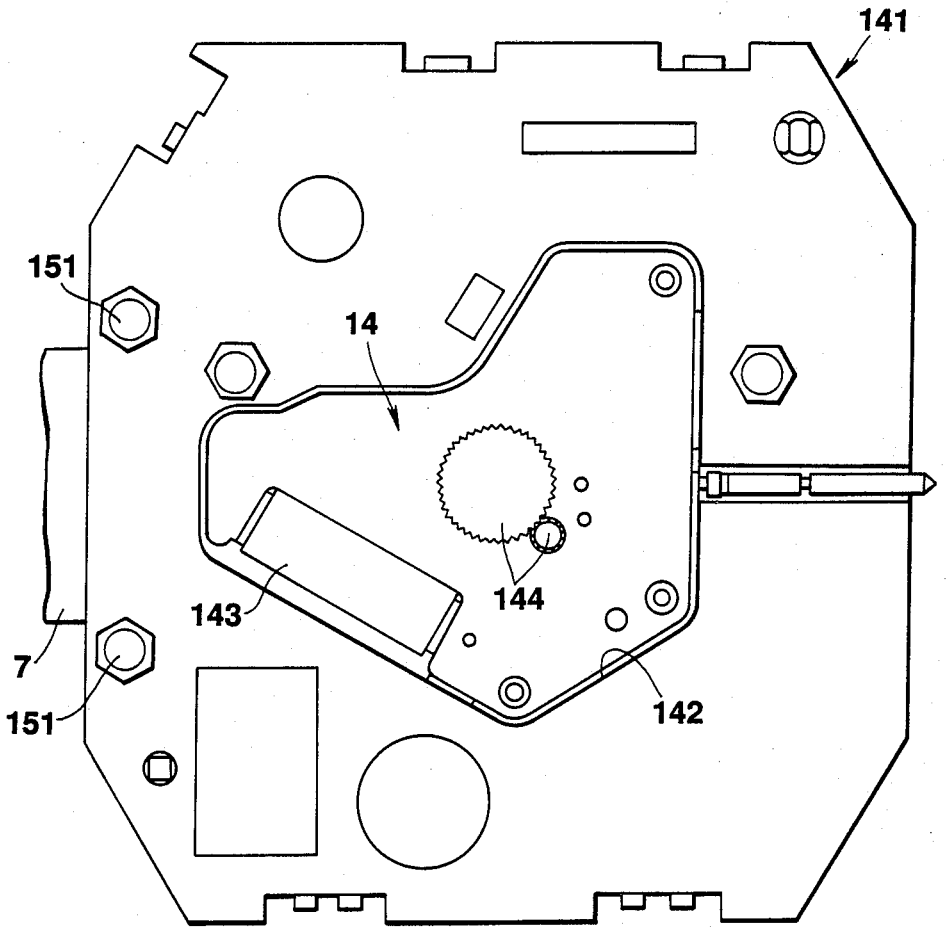
FIG. 39 is a plan view showing an upper housing of the electronic wristwatch in FIG. 35.
Figure 40:
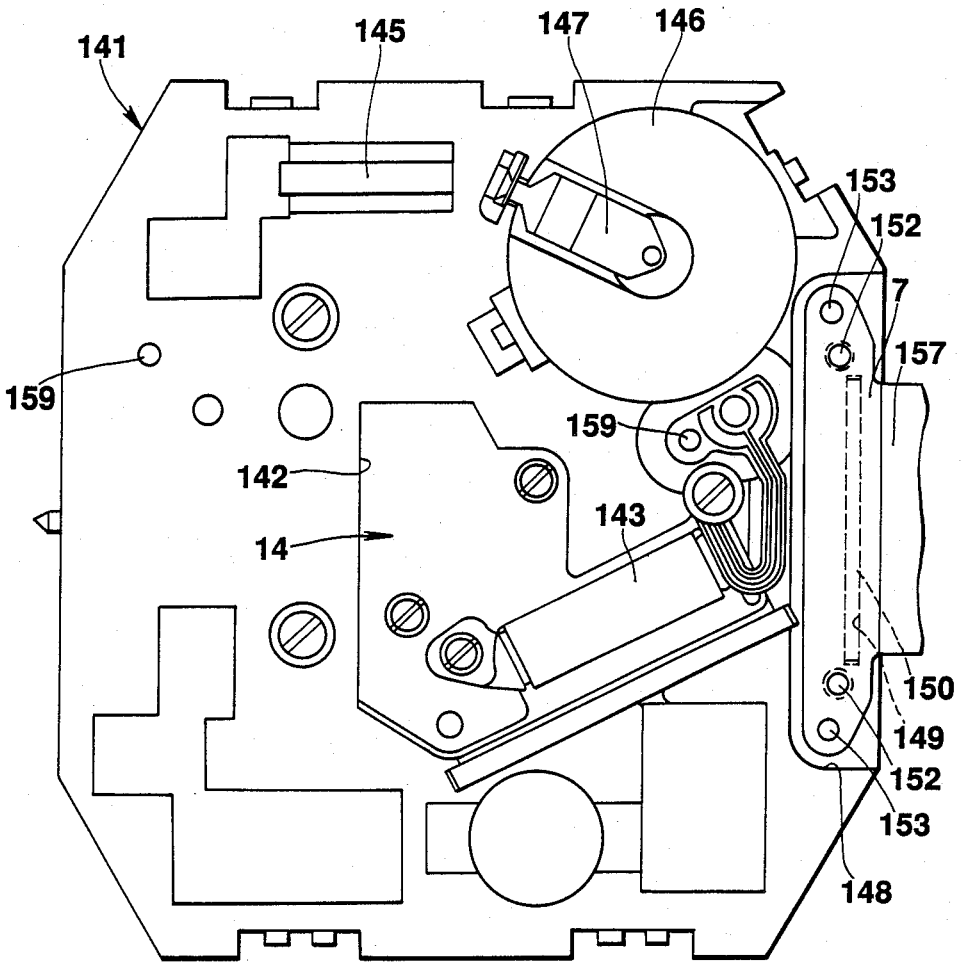
FIG. 40 is a bottom view showing the upper housing in FIG. 39.

FIGS. 39 and 40 respectively show the upper and lower surfaces of an upper housing 141 housed in the case 1.

An analog movement housing opening 142 is formed in a central portion of the upper housing 141. An analog movement comprising a step motor 143 and a wheel train mechanism 144 is housed in the analog movement housing opening 142. A quartz oscillator housing opening 145 and a battery housing opening 146 are formed in the lower surface of the upper housing 141 at the 12-o'clock side. A negative battery electrode plate 147 is mounted in the battery housing opening 146.

Figure 43:
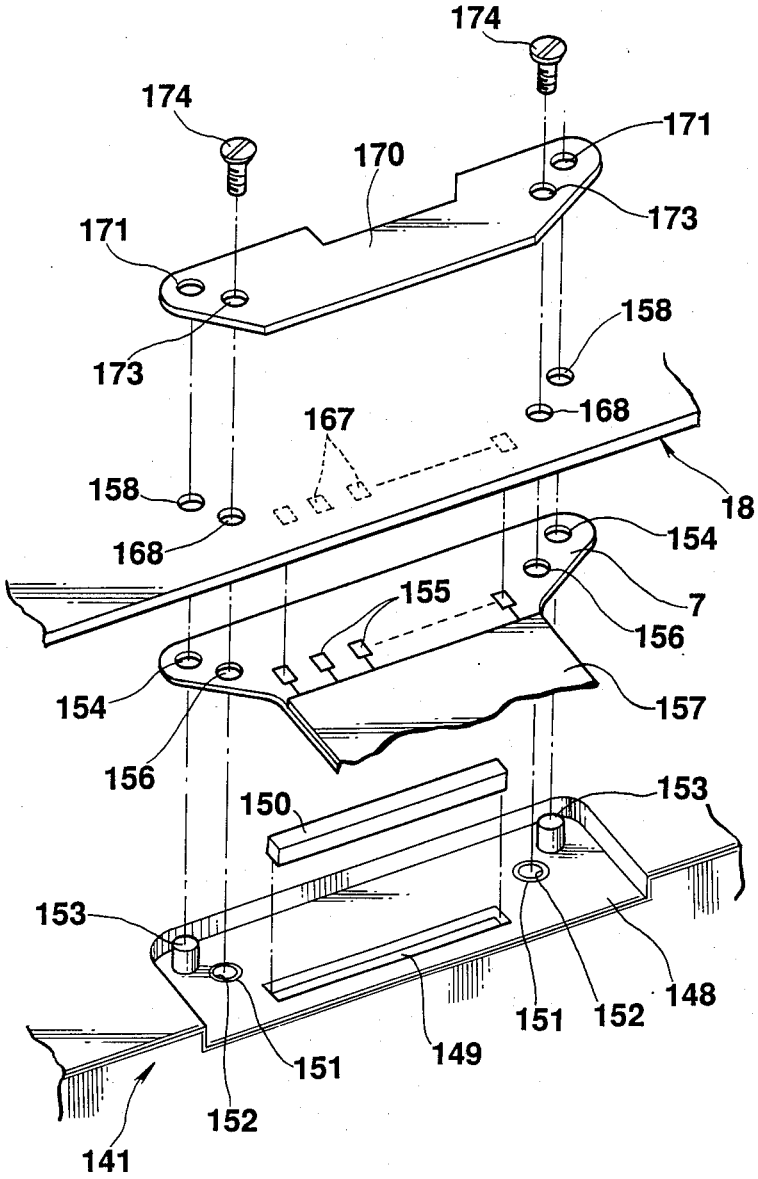
FIG. 43 is an exploded perspective view showing a connecting portion of the circuit board and a flexible wiring board of the electronic wristwatch in FIG. 35.

A flexible wiring board connecting recess 148 is formed in the lower surface of the upper housing 141 at the 9-o'clock side (right side in FIG. 40), as shown in FIG. 43. A linear rubber member housing recess 149 is formed in the flexible wiring board connecting recess 148. A rubber member 150 is housed in the rubber member housing recess 149 so as to partially protrude therefrom. In the flexible wiring board connecting recess 148, screw holes 152 respectively formed at supports 151 embedded in the upper housing 141 are exposed at both the sides of the rubber member housing recess 149. Positioning bosses 153 are respectively formed near the screw holes 152 in the flexible wiring board connecting recess 148. Positioning holes 154 which are formed in one end portion of the flexible wiring board 7 forcibly fit in these positioning bosses 153. One end portion of the flexible wiring board 7 is fixed in the flexible wiring board connecting recess 148 while being in contact with the protrusion surface of the rubber member 150. A plurality of connecting elements 155 are mounted on the upper surface of the flexible wiring board 7 at a portion corresponding to the rubber member 150 in FIG. 43. Two screw insertion holes 156 are formed in the flexible wiring board 7 at positions corresponding to the screw holes 152 of the recess 148, respectively. An insulating sheet 157 is bonded to the flexible wiring board 7 except for one end portion described above.

Figure 41:
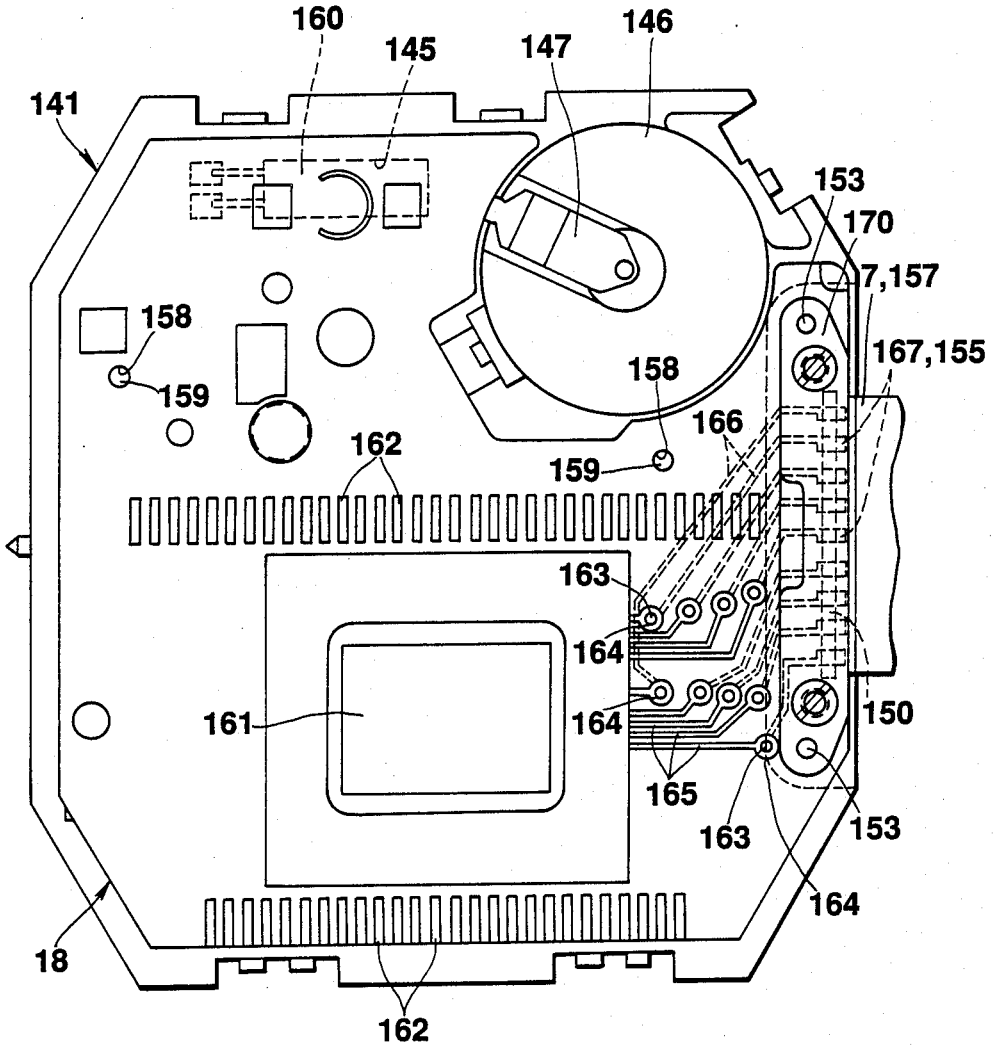
FIG. 41 is a bottom view showing a state wherein circuit board and the like are mounted on the upper housing in FIG. 39.

FIG. 41 shows a state wherein a circuit board 18 is mounted in the upper housing 141.

The circuit board 18 is arranged on the lower surface of the upper housing 141 in such a manner that positioning holes 158 (partially shown in FIG. 43) formed at four predetermined positions of the circuit board 18 respectively forcibly fit over positioning bosses 159 formed at two predetermined positions on the lower surface of the upper housing 141 and the above-described positioning bosses 153 of the flexible wiring board 7. In this state, a quartz oscillator 160 mounted on the upper surface (lower surface in FIG. 41) of the circuit board 18 is housed in the quartz oscillator housing opening 145 of the upper housing 141. An LSI 161 is arranged at a predetermined position on the lower surface (upper surface in FIG. 41) of the circuit board 18. Two groups of liquid crystal data display panel connecting terminals 162 respectively form lateral arrays at the 12- and 6-o'clock sides of the LSI 161. These connecting terminal groups 162 are electrically connected to the LSI 161 through leads (not shown).

Through holes 163 are formed at a plurality of positions of the circuit board 18 at the 9-o'clock side (right in FIG. 41) of the LSI 161. Through-hole connected through hole terminals 164 are respectively formed around both the ends of each of these through holes 163. The through hole terminals 164 on the lower surface (upper surface in FIG. 41) of the circuit board 18 are electrically connected to the LSI 161 through leads 165. The through hole terminals 164 on the upper surface (lower surface in FIG. 41) of the circuit board 18 are electrically connected to flexible wiring board connecting terminals 167 of the circuit board 18 through leads 166, respectively.

Screw insertion holes 168 (see FIG. 43) are formed in the circuit board 18 at positions corresponding to the two screw holes 152 in the flexible wiring board connecting recess 148 of the upper housing 141. A metal reinforcing plate 170 is arranged at a predetermined position on the lower surface (upper surface in FIGS. 41 and 43) cf the circuit board 18. Two positioning holes 171 are formed in the reinforcing plate 170 at positions respectively corresponding to the two positioning bosses in the flexible wiring board connecting recess 148 of the upper housing 141. In addition, screw insertion holes 173 are formed in the reinforcing plate 170 at positions respectively corresponding to the two screw holes 152 in the recess 148. The reinforcing plate 70 is fixed to the upper housing 141 in such a manner that the two positioning holes 171 forcibly fit over the two positioning bosses in the recess 148 of the upper housing 141, and screws 174 are then threadably engaged with the screw holes 152 in the recess 148 of the upper housing 141 through the screw insertion holes 173, 168 and 156 of the reinforcing plate 170, the circuit board 18, and the flexible wiring board 7, respectively. In this state, the connecting terminals 155 of the flexible wiring board 7 ar urged by the connecting terminals 167 of the circuit board 18 due to the repulsive force of the properly compressed rubber member 150, so that the terminals 155 and 167 are electrically connected.

Figure 42:
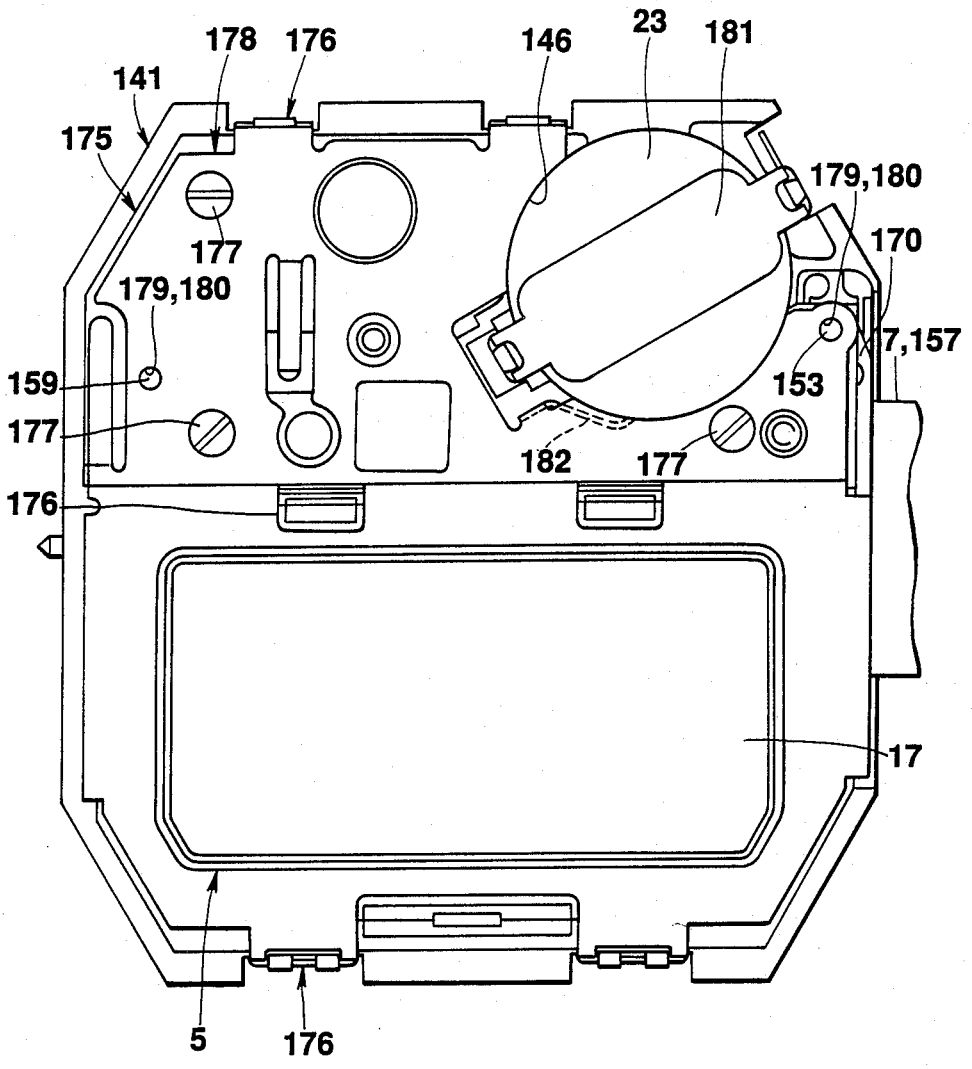
FIG. 42 is a bottom view showing a state wherein a lower housing and the like are mounted on the upper housing in FIG. 41.

FIG. 42 shows a state wherein a lower housing 175 is attached to the upper housing 141.

The lower housing 175 is urged against the circuit board 18 by a support plate 178 which is fixed to the upper housing 141 with hook mechanisms 176 and screws 177. The lower housing 175 is arranged on the lower surface (upper surface in FIG. 42) of the circuit board 18 such that positioning holes 179 (some of them are not shown) formed at four predetermined positions of the lower housing 175 receive the positioning bosses 153 and 159 of the upper housing 141 in the same manner as that of the circuit board 18. The support plate 178 is fixed to the upper housing 141 with the hook mechanisms 176 and the screws 177 while positioning holes 180 formed at two predetermined positions of the support plate 178 receive the positioning bosses 153 and 159 of the upper housing 141. A battery 23 is housed in the battery housing opening 146 of the upper housing 141 while the battery 23 is urged by a battery press plate 181. The battery 23 is electrically connected to the circuit board 18 through the above-described negative battery electrode plate 147 (see FIG. 41) and a positive battery electrode plate 182 integrally formed with the support plate 178.

Two groups of connecting terminals (not shown) are mounted at the 12- and 6-o'clock sides of the upper surface (lower surface in FIG. 42) of the liquid crystal data display panel 17 housed in the lower housing 175 so as to oppose the two groups of liquid crystal data display panel connecting terminals 162 of the circuit board 18. The two groups of connecting terminals (not shown) of the display panel 17 and the two groups of connecting terminals of the circuit board 18 are electrically connected to each other through a rectangular parallel-piped interconnector (not shown).

As has been described above, in this electronic wrist watch, the case 1 is attached to the 9-o'clock side of the plate 2 through the hinge pin 140 so as to be freely opened and closed, and the flexible wiring board 7 extends at the coupling portion between the case 1 and the plate 2. With this arrangement, since the flexible wiring board connecting terminals 167 are mounted at the 9-o'clock side of the circuit board 18, the wiring patterns 164, 165, and 166 for connecting these connecting terminals 167 to the LSI 161 can be formed without interference with the liquid crystal data display panel connecting terminals 162 and electronic parts such the battery 23 and the quartz oscillator 160. As a result, the circuit board 18 can be reduced in size, and wiring patterns can be easily formed.

In the above-described embodiment, the case 1 is attached to the 9-o'clock side of the plate 2 so as to be freely opened and closed. However, the present invention is not limited to this. For example, the case 1 can be attached to the 3-o'clock side of the plate 2.

What is claimed is:

1. An electronic wrist watch having an analog time display unit and an electrooptic data display unit, comprising:

a single flat plate member having an upper surface on which a switch input section for data input is mounted, and a lower surface which is contacted with a user's hand;

a case member which is attached to one end of said plate member so as to be freely opened and closed over said plate member, said switch input section being exposed for operation by a user when said case member is opened;

an analog time display unit, housed in said case member at an upper surface thereof, for displaying time with hands;

an electrooptic data display unit, housed in said case member at a lower surface thereof, for displaying data; and an electronic circuit, housed in said case member, for driving said analog time display unit, said electronic circuit being electrically connected to said switch input section so as to cause said electrooptic data display unit to display data input from said switch input section; wherein said analog time display unit comprises an analog movement for driving said hands;

said analog movement and said electrooptic data display unit are arranged in said case member so as to be vertically stacked on each other;

a battery is provided in said case member for driving said analog time display unit and said electrooptic data display unit; and said electronic circuit is arranged abreast of said analog movement and said electrooptic data display unit so as not to be stacked thereon.

2. An electronic wrist watch having an analog time display unit and an electrooptic data display unit, comprising:

a single flat plate member having an upper surface on which a switch input section for data input is mounted, and a lower surface which is contacted with a user's hand;

a case member which is attached to one end of said plate member so as to be freely opened and closed over said plate member, said switch input section being exposed for operation by a user when said case member is opened;

an analog time display unit, housed in said case member at an upper surface thereof, for displaying time with hands;

an electrooptic data display unit, housed in said case member at a lower surface thereof, for displaying data; and an electronic circuit, housed in said case member, for driving said analog time display unit, said electronic circuit being electrically connected to said switch input section so as to cause said electrooptic data display unit to display data input from said switch input section;

wherein said switch input section comprises a sheet switch means; and said case member comprises an upper half case and a lower half case, and said upper and lower half cases having a coupling portion for coupling said upper and lower half cases together; and said sheet switch means having one end which extends between said upper half case and said lower half case and which is inserted in said case member so as to be connected to said electronic circuit, a frame-like seal portion being integrally formed with said sheet switch, said frame-like seal portion having substantially the same shape as that of said coupling portion of said upper half case and said lower half case and being clamped therebetween.

3. An electronic wrist watch having an analog time display unit and an electrooptic data display unit, comprising:

a single flat plate member having an upper surface on which a switch input section for data input is mounted, and a lower surface which is contacted with a user's hand;

a case member which is attached to one end of said plate member so as to be freely opened and closed over said plate member, said switch input section being exposed for operation by a user when said case member is opened;

an analog time display unit, housed in said case member at an upper surface thereof, for displaying time with hands;

an electrooptic data display unit, housed in said case member at a lower surface thereof, for displaying data; and an electronic circuit, housed in said case member, for driving said analog time display unit, said electronic circuit being electrically connected to said switch input section so as to cause said electrooptic data display unit to display data input from said switch input section; wherein a plurality of projections are mounted on a surface of said case member which opposes said plate member when said case member is set at a closing position, said projections simultaneously depressing a plurality of specific keys of said switch input section of said plate member when said case member is set at the closing position;

said electronic circuit comprises detecting means for detecting depression of said plurality of specific keys and detecting that said case member is set at the closing position, and display control means for causing said electrooptic data display unit to stop a display of data when said detecting means detects that said case member is set at the closing position.

4. An electronic wrist watch having an analog time display unit and an electrooptic data display unit, comprising:

a single flat plate member having an upper surface on which a switch input section for data input is mounted, and a lower surface which is contacted with a user's hand;

a case member which is attached to one end of said plate member so as to be freely opened and closed over said plate member, said switch input section being exposed for operation by a user when said case member is opened;

an analog time display unit, housed in said case member at an upper surface thereof, for displaying time with hands;

an electrooptic data display unit, housed in said case member at a lower surface thereof, for displaying data; and an electronic circuit, housed in said case member, for driving said analog time display unit, said electronic circuit being electrically connected to said switch input section so as to cause said electrooptic data display unit to display data input from said switch input section; wherein said case member comprises an upper half case for housing said analog time display unit, and a lower half case for housing said electrooptic data display unit, said upper half case and said lower half case being detachably coupled to each other.

5. A wrist watch according to claim 4, wherein said upper half case and said lower half case are coupled to each other so as to be freely openable and closeable.

6. An electronic wrist watch having an analog time display unit and an electrooptic data display unit, comprising:

a single flat plate member having an upper surface on which a switch input section for data input is mounted, and a lower surface which is contacted with a user's hand;

a case member which is attached to one end of said plate member so as to be freely opened and closed over said plate member, said switch input section being exposed for operation by a user when said case member is opened;

an analog time display unit, housed in said case member at an upper surface thereof, for displaying time with hands;

an electrooptic data display unit, housed in said case member at a lower surface thereof, for displaying data; and an electronic circuit, housed in said case member, for driving said analog time display unit, said electronic circuit being electrically connected to said switch input section so as to cause said electrooptic data display unit to display data input from said switch input section; wherein a movable member is arranged in said case member so as to freely protrude and retract; and an engaging portion is formed in said plate member, said engaging portion being engaged with an end of said movable member when said case member is set at the closing position.

7. A wrist watch according to claim 6, further comprising a switch arranged in said case member and which is turned on and off upon protrusion and retraction of said movable member so as to detect opening/closing of said case member with respect to said plate member.

8. A wrist watch according to claim 13, wherein:

a switch is arranged in said case member, said switch being turned on and off upon protrusion and retraction of said movable member so as to detect opening/closing of said case member with respect to said plate member; and said electronic circuit comprises display control means for causing said electrooptic data display unit to stop a display of data when said switch detects that said case member is set at the closing position.

9. An electronic wrist watch having an analog display unit and an electrooptic data display unit, comprising:

a single flat plate member having upper and lower surfaces, and band attaching portions at both ends thereof, said lower surface being contacted with a user's hand;

a keyboard including a large number of keys for data input, said keyboard being mounted on said upper surface of said single flat plate member;

a case member attached to one end of said plate members so as to be freely opened and closed over said plate member, said keyboard being exposed for operation by a user when said case member is opened;

an analog time display unit, housed in said case member at an upper surface thereof, for displaying time with hands; and an electrooptic data display unit, housed in said case member at a lower surface thereof, for displaying data input from said keyboard which is mounted on said plate member; wherein said analog time display unit comprises an analog movement for driving said hands;

said analog movement and said electrooptic data display unit are arranged in said case member so as to be vertically stacked on each other; and a battery is provided in said case member for driving said analog time display unit and said electrooptic data display unit, said battery being arranged abreast of said analog movement and said electrooptic data display unit so as not to be stacked thereon.

10. An electronic wrist watch having an analog display unit and an electrooptic data display unit, comprising:

a single flat plate member having upper and lower surfaces, and band attaching portions at both ends thereof, said lower surface being contacted with a user's hand;

a keyboard including a large number of keys for data input, said keyboard being mounted on said upper surface of said single flat plate member;

a case member attached to one end of said plate members so as to be freely opened and closed over said plate member, said keyboard being exposed for operation by a user when said case member is opened;

an analog time display unit, housed in said case member at an upper surface thereof, for displaying time with hands; and an electrooptic data display unit, housed in said case member at a lower surface thereof, for displaying data input from said keyboard which is mounted on said plate member; wherein said case member comprises an upper half case and a lower half case, said upper and lower half cases having a coupling portion for coupling said upper and lower half cases together;

an electronic circuit is housed in said case member, said electronic circuit being adapted to drive said analog time display unit and being electrically connected to said keyboard of said plate member so as to cause said electrooptic data display unit to display data input from said keyboard;

said keyboard comprises a sheet switch means having a frame-like seal portion integrally formed therewith; and one end of said sheet switch means extends between said upper half case and said lower half case and is inserted in said case member so as to be connected to said electronic circuit, said frame-like seal portion having substantially the same shape as that of said coupling portion of said upper half case and said lower half case and being clamped therebetween.

11. An electronic wrist watch having an analog display unit and an electrooptic data display unit, comprising:

a single flat plate member having upper and lower surfaces, and band attaching portions at both ends thereof, said lower surface being contacted with a user's hand;

a keyboard including a large number of keys for data input, said keyboard being mounted on said upper surface of said single flat plate member;

a case member attached to one end of said plate members so as to be freely opened and closed over said plate member, said keyboard being exposed for operation by a user when said case member is opened;

an analog time display unit, housed in said case member at an upper surface thereof, for displaying time with hands; and an electrooptic data display unit, housed in said case member at a lower surface thereof, for displaying data input from said keyboard which is mounted on said plate member; wherein said case member comprises an upper half case for housing said analog time display unit, and a lower half case for housing said electrooptic data display unit, said upper half case and said lower half case being detachably coupled to each other.

12. A wrist watch according to claim 11, wherein said upper half case and said lower half case are coupled to each other so as to be freely openable and closeable.

13. An electronic wrist watch having an analog display unit and an electrooptic data display unit, comprising:

a single flat plate member having upper and lower surfaces, and band attaching portions at both ends thereof, said lower surface being contacted with a user's hand;

a keyboard including a large number of keys for data input, said keyboard being mounted on said upper surface of said single flat plate member;

a case member attached to one end of said plate members so as to be freely opened and closed over said plate member, said keyboard being exposed for operation by a user when said case member is opened;

an analog time display unit, housed in said case member at an upper surface thereof, for displaying time with hands; and an electrooptic data display unit, housed in said case member at a lower surface thereof, for displaying data input from said keyboard which is mounted on said plate member; wherein a movable member is mounted in said case member so as to freely protrude and retract; and an engaging portion is mounted in said plate member, said engaging portion being engaged with an end of said movable member when said case member is set at the closing position.

14. A wrist watch according to claim 13, further comprising a switch mounted in said case member and which is turned on and off upon protrusion and retraction of said movable member so as to detect opening/closing of said case member.

* * * * *